US006227642B1

(12) United States Patent
Hanabusa et al.

(10) Patent No.: US 6,227,642 B1
(45) **Date of Patent: *May 8, 2001**

(54) WASTE INK CONTAINER INK LEVEL MONITORING IN AN INK JET RECORDER

(75) Inventors: Tadashi Hanabusa; Koh Hasegawa; Seiji Takahashi, all of Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 67 days.

(21) Appl. No.: 08/885,812

(22) Filed: Jun. 30, 1997

Related U.S. Application Data

(63) Continuation of application No. 08/762,250, filed on Dec. 9, 1996, now abandoned, which is a continuation of application No. 08/174,457, filed on Dec. 28, 1993, now abandoned.

(30) Foreign Application Priority Data

| | | |
|---|---|---|
| Dec. 28, 1992 | (JP) | 4-348676 |
| Jun. 3, 1993 | (JP) | 5-133639 |
| Jul. 8, 1993 | (JP) | 5-169198 |

(51) Int. Cl.[7] ..... B41J 2/165
(52) U.S. Cl. ..... 347/19; 347/23; 347/36
(58) Field of Search ..... 347/7, 19, 22, 347/23, 30, 31, 32, 36

(56) References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 4,926,196 * | 5/1990 | Mizoguchi et al. | 347/23 |
| 4,965,596 * | 10/1990 | Nogoshi et al. | 347/36 |
| 5,049,898 * | 9/1991 | Arthur et al. | 347/19 |
| 5,172,140 * | 12/1992 | Hirabayshi et al. | 347/36 |
| 5,764,253 | 6/1998 | Uchikata et al. | 347/23 |

FOREIGN PATENT DOCUMENTS

| | | | |
|---|---|---|---|
| 3604373 | 8/1986 | (DE) . | |
| 0480473 | 4/1992 | (EP) . | |
| 0 535 686 * | 4/1993 | (EP) | 347/23 |
| 0 556 011 * | 8/1993 | (EP) | 347/23 |
| 54-056847 | 5/1979 | (JP) . | |

(List continued on next page.)

*Primary Examiner*—John Barlow
*Assistant Examiner*—Craig A. Hallacher
(74) *Attorney, Agent, or Firm*—Fitzpatrick, Cella, Harper & Scinto

(57) ABSTRACT

In an ink jet recording apparatus, a plurality of kinds of heads are separately mounted and a waste ink container is provided. The ink level of the waste ink container is monitored, and the kind of ink jet head mounted is detected. The amount of waste ink exhausted from a mounted ink jet recording head is corrected in response to the kind of ink jet head mounted. Each kind of ink jet printhead mounted has distinct waste ink exhaust properties caused by factors such as different size of ink drops, or different number of printhead exhaust ports which affect preliminary discharge amounts of waste ink and factors such as different suction loads on the ink tanks, different flow resistances of the ink flow passages and different viscosities of the inks used in the printheads which affect suction recovery amounts of waste ink. The recovery function is corrected such that the waste ink amount exhausted from the mounted head is carried out in accordance with the mounted ink jet head.

17 Claims, 23 Drawing Sheets

FOREIGN PATENT DOCUMENTS

| | | | | |
|---|---|---|---|---|
| 59-123670 | | 7/1984 | (JP) . | |
| 59-138461 | | 8/1984 | (JP) . | |
| 60-071260 | | 4/1985 | (JP) . | |
| 1-99853 | * | 4/1989 | (JP) | 347/23 |
| 1-184146 | * | 7/1989 | (JP) | 347/36 |
| WO 9104156 | | 4/1991 | (WO) . | |

* cited by examiner

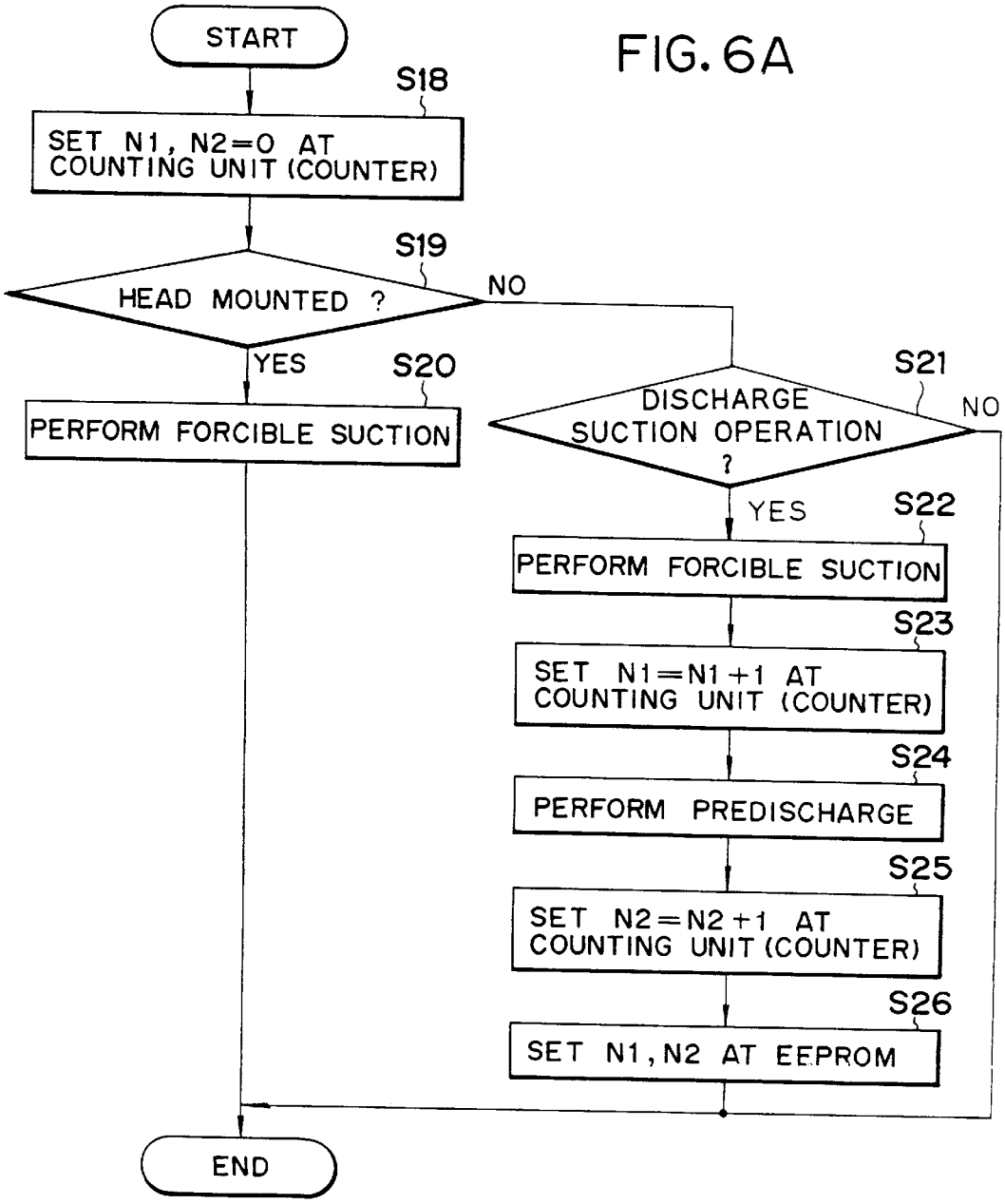
FIG. 6A
FIG. 6B
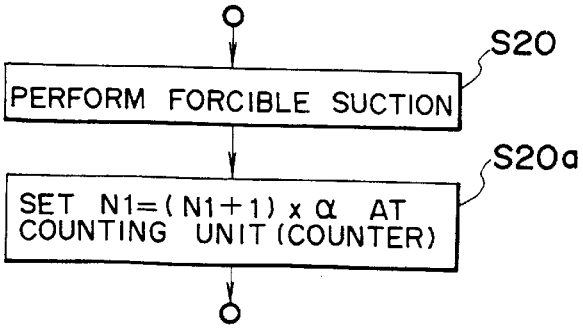

INK SUPPLY PATH (A)

EXHAUST INK PATH (B)

AIR PATH (C)

WASTE INK CONTAINER INK LEVEL MONITORING IN AN INK JET RECORDER

This application is a continuation of application Ser. No. 08/762,250 filed Dec. 9, 1996, now abandoned which is a continuation of application Ser. No. 08/174,457 filed Dec. 28, 1993 now abandoned.

BACKGROUND OF THE INVENTION

1. Field of the Invention

The present invention relates to an ink jet recording apparatus which uses an ink jet head. More particularly, the invention relates to an exhaust ink processing.

2. Related Background Art

The recording apparatus for recording on a sheet, an OHP sheet, or other recording media has been in practice in a mode in which to install a recording head of various recording methods. For a recording head, there are available a wire dot method, a thermo-sensitive method, a thermal transfer method, and an ink jet method among others. Since the ink jet method is to discharge ink directly onto a recording medium, a particular attention is given as a quiet recording method which is executable at a low running cost.

For the above-mentioned ink jet recording apparatus, a discharge recovery process is usually performed in order to maintain its ink discharge from the recording head in a good condition.

As an example of the discharge recovery process, there is a process (preliminary discharge) for removing the air bubbles and dust particles, which will cause defective discharges to take place or cause ink to become overly viscous and no longer suitable for recording, by providing a cap capable of abutting on and retracting from the discharging port formation surface of the recording head; by allowing the cap to face the discharging port formation surface of the recording head; and by driving the energy generating elements arranged in the nozzles of the recording head for discharging ink in order to discharge ink from the entire discharging ports. Aside from the foregoing preliminary discharge, there is also a process for removing the causes of defective discharge by the application of a forcible suction of ink from the entire discharging ports to exhaust it by use of a suction pump while the discharging port formation surface is covered with the cap.

The ink which is exhausted by the preliminary discharge to the cap is removed from the cap by means of a suction pump.

The ink exhausted from the recording head by the execution of the discharge recovery process such as the forcible suction, preliminary discharge, or the like is conducted by means of the suction pump for storage to an ink retaining member which is connected to the pump. The size or the ink storage capacity of the ink retaining member is regulated by the size of a recording apparatus, the size of an information processing apparatus incorporated in the recording apparatus, and others. Also, in order to store ink efficiently, a part of the ink retaining member is conductively connected to the atmosphere, among some other means, so that the ink is being dried and evaporated while in storage.

Nevertheless, if the ink should flow into the ink retaining member in an amount beyond such a regulated capacity of storage, there might be some cases that the ink intended for storage leaks from the ink retaining member. In general, ink often contains water and some other conductive substances, then the ink which leaks may lead to an accident. Therefore, a sufficient preventive measure should be taken against any leakage of ink.

As an example of the preventive measures, there is devised a method wherein the execution numbers of the suction pump connected to the aforesaid ink retaining member are counted; the stored amount of ink in the ink retaining member is calculated by multiplying the ink inflow to the ink retaining member per execution of the suction pump by the numbers obtained as a result of the aforesaid counting; and a warning is issued to the operator of the recording apparatus when the in-flow of ink reaches the regulated amount of storage.

On the other hand, in a recording apparatus using the recording head which is integrally formed by a recording head and an ink tank, which is arranged to be replaceable in the recording apparatus or a recording apparatus using the recording head and ink tank which are arranged to be individually replaceable for a carriage, the operator executes recording while replacing the recording heads and ink tanks which are provided particularly for the use of different colors of ink. A structure of the kind with which a color printing is easily executable is also in practical use recently.

In a recording apparatus having such a structure as above, there is a possibility that the ink which adheres to the cap is mixed with ink to be used for a color printing because the cap and others, which are the same as those usually used for the conventional head for black ink, abut upon the discharging port formation surface of the recording head for the ink of difference colors. Particularly when the ink remains in the cap in a considerable amount due to the discharge recovery process, the probability for ink mixture is obviously high.

As a measure to prevent this kind of defectiveness from taking place, there has been devised a method wherein before any recording head for color use is installed, the suction pump connected to the cap is actuated for the removal of the ink in the cap while no recording head is mounted, and then, after the ink in the cap is removed, the recording head for color use is installed or a method wherein after the completion of a series of recording operations, the operator is requested to remove the ink in the cap by actuating the suction pump while the cap is kept in a position where it does not abut upon the discharging port formation surface, or an arrangement is made to execute this type of operation automatically.

However, the following problems are encountered in the above-mentioned conventional preventive measures:

When the storage in the ink retaining member is obtained by counting the execution numbers of the suction pump which enables ink to flow into the ink retaining member, the amount of ink sucked from the recording head per suction operation is measured in advance in a state that the cap and the discharging port formation surface of the recording head abut upon each other, and then, the amount of the ink storage is obtained by multiplying the ink amount per suction by the total number of the suction operations.

In the case of this method, however, errors tend to occur between the amount of the ink storage thus calculated and the actual amount of ink storage. As a result, a warning is often given earlier despite the fact that there is still a good room for ink storage.

The major cause of a problem of the kind is that when the suction operation is executed in a state that the cap does not abut upon the discharging port formation surface of the recording head as in the case of mounting the recording head for color use, that is, the event that the suction operation is executed in a state which does not allow any ink to be exhausted by the suction operation, the ink in-flow to the ink retaining member becomes extremely small or "zero" as compared with the case that the suction is executed while the cap and recording head abut upon each other.

Further, the amount of ink which is exhausted by the preliminary discharge into the cap which serves as an ink receptacle for the above-mentioned discharge recovery is "zero" when no recording head is installed.

Also, when using a recording head whose characteristic properties regarding the amount of exhaust ink are different, there are some cases that the amount of ink storage cannot be calculated exactly. As an example, if the ink used by a recording apparatus is different in its viscosity, the amount of ink discharged by the above-mentioned preliminary discharge also differs, and further, it may affect the amount of exhausted ink by the above-mentioned suction operation in some cases.

Also, the ink viscosity varies by changes in the ambient temperature and others, thus varying the amount of exhausted ink from the recording head. As a result, it becomes impossible to measure the amount of ink storage exactly.

Also, when a warning is given regarding the amount of the ink storage in the ink retaining member, it is necessary to replace the ink retaining members. Therefore, a warning of the kind must be given more accurately.

If such a warning is not exact, the ink which is liquid may leak from the ink retaining member, leading to the malfunction of the recording apparatus and the contamination in it. There is also a danger that the ink which has leaked is ignited.

Also, when the amount of exhaust ink to be stored in the ink retaining member reaches the regulated storage, it is necessary to replace the ink retaining members.

SUMMARY OF THE INVENTION

The present invention is designed to solve the above-mentioned problems. It is an object of the invention to provide an ink jet recording apparatus capable of executing an optimal process in accordance with the amount of ink to be stored in an ink retaining member.

It is another object of the present invention to provide an ink jet recording apparatus capable of executing the calculation more accurately by the measurement of ink stored in an ink retaining member. It is still another object of the present invention to provide an ink jet recording apparatus capable of exactly measuring the stored ink by means of an ink exhaust mechanism by obtaining the measured value of ink to be stored after correction in accordance with the operational condition of the ink exhaust mechanism which exhausts ink from a recording head and from an ink supply member as well.

It is a further object of the present invention to provide a reliable ink jet recording apparatus capable of electrically detecting the ink leakage from an exhaust ink retaining member to the interior of the apparatus by use of a part of the electric circuit patterns in order to give a warning, suspend the apparatus, or execute other processes.

It is still a further object of the present invention to provide an ink jet recording apparatus capable of reusing the absorbent in an exhaust ink retaining member containing a regulated amount of exhausted ink.

It is another object of the present invention to provide an ink jet recording apparatus using an ink jet recording head which discharges from the discharging ports the ink supplied from an ink container for recording on a recording medium, comprising an ink exhaust mechanism which receives ink discharged from the ink discharging ports, and exhausts the ink to an exhaust ink retaining unit; an ink measuring unit to measure the amount of ink to be stored in the aforesaid exhaust ink retaining unit; and a control unit to correct the value of the stored amount of ink measured by the aforesaid ink measuring unit in accordance with the operational condition of the aforesaid ink exhaust mechanism.

BRIEF DESCRIPTION OF THE DRAWINGS

FIG. 6A is a view illustrating a method for measuring ink stored according to the second embodiment.

FIG. 6B is a view illustrating a method for measuring ink stored which is developed according to the second embodiment.

DETAILED DESCRIPTION OF THE PREFERRED EMBODIMENTS (First Embodiment)

Figure 1:
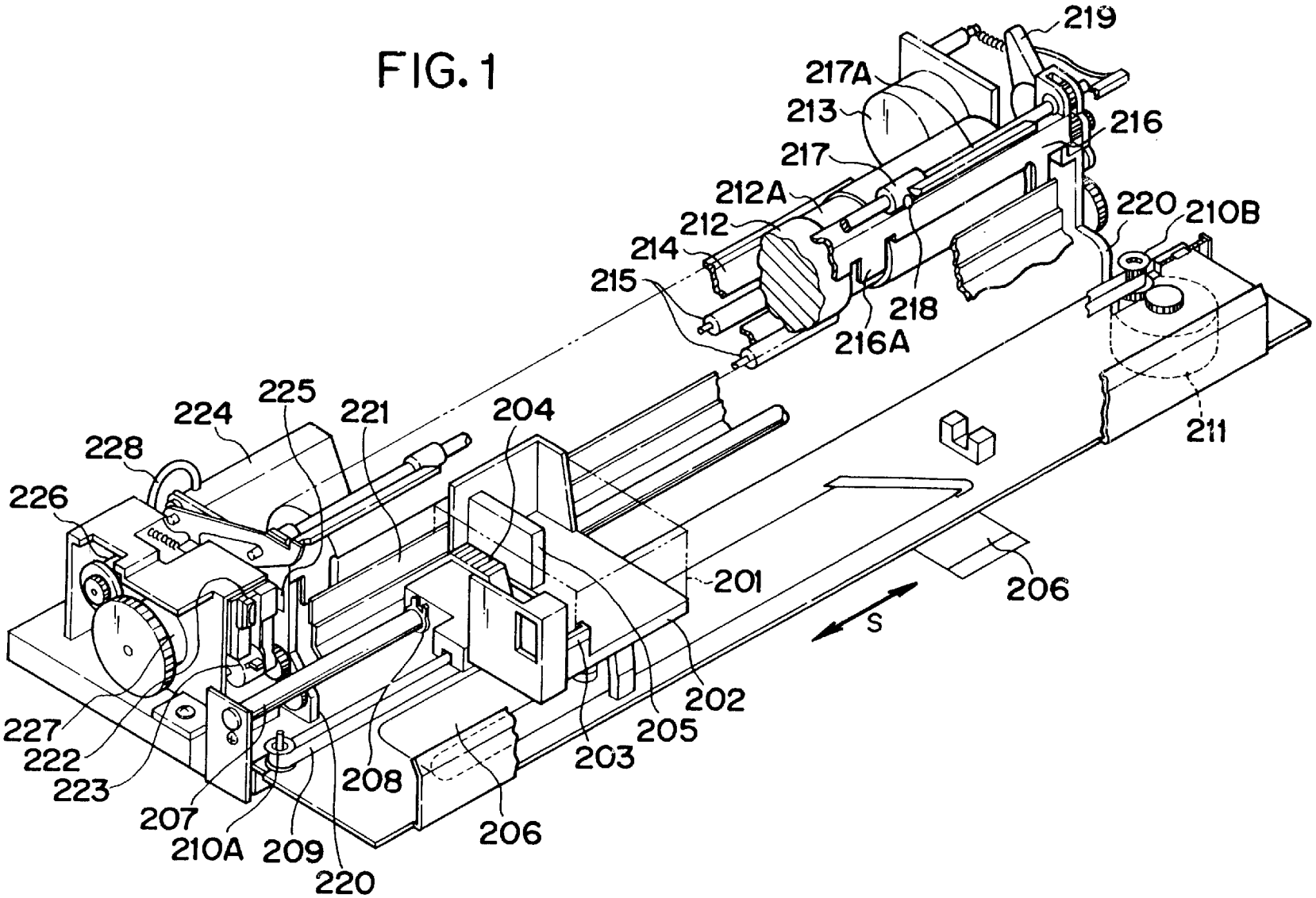
FIG. 1 is a perspective view schematically illustrating an ink jet recording apparatus to which an embodiment according to the present invention is applicable.

FIG. 1 shows the structural example of an ink jet recording apparatus to which an embodiment according to the present invention is applicable.

Here, a reference numeral 201 designates a head cartridge having an ink jet recording head which uses black ink. For a recording apparatus according to the present embodiment, the structure is arranged to enable a head cartridge for color use 201C (not shown) to be installed, which is in the same mode as the head cartridge 201 for use of black ink. A reference numeral 202 designates a carriage having such head cartridge mounted on it for scanning in the directions indicated by arrows S in FIG. 1; 203, a hook to mount the head cartridge 201 to the carriage 203; 204, a lever to operate the hook 203; 205, a supporting board to support the electrical connection with the head cartridge 201; 206, the FPC (flexible printed circuit) to make the electrical connection with a controller for the apparatus main body; 207, a guide shaft to guide the carriage 202 in the directions S, which is inserted through a bearing 208; 209, a timing belt tensioned around pulleys 210A and 210B arranged on both sides of the apparatus, respectively, in order to transmit the power to the carriage 202 mounted on the belt so that the carriage can travel in the directions S. To the pulley 210B on one end, the driving power is transmitted from a carriage motor 211 through a transmission mechanism comprising gears and others. A reference numeral 212 designates a carrier roller which regulates the setting plane for a sheet, an OHP sheet made of resins or the like, a cloth, or other recording medium, and at the same time, feeds the recording medium for recording, which is driven by a feed motor 213; 214, a paper pan to guide the recording medium to the recording positions; 215, pinch rollers which are arranged on the feeding path of the recording medium to press the recording medium to the feed roller 212 for feeding; 216, a platen which faces the discharging ports of the head cartridge 201 to regulate the recording surface of a recording medium; 217, an exhaust sheet roller which is arranged on the down stream side of the recording position in the feed direction of the recording medium in order to exhaust the sheet toward an exhaust outlet which is not shown; 218, a spur provided for the exhaust sheet roller 217, which presses the exhaust sheet roller 217 through the recording medium to generate a force for feeding the recording medium; 219, a release lever to release the bias given respectively to the pinch rollers 215 and the spur 218 in setting the recording medium or in similar occasions.

The platen 216 is rotatively supported by the shaft of the exhaust sheet roller 217 at both ends, and is biased from the stop positions of the plates 220 on the left and right sides toward the front part 221 of the paper pan 214. The inner side of the front part 221 of the paper pan abuts on the plural portions 212A of the feed roller 212, which are smaller than the outermost periphery of the roller.

A reference numeral 222 designates a cap made of a resilient material such as rubber, which faces the ink discharging port formation surface of the recording head at its home position, and which is supported so that the cap abuts upon or retracts from the recording head. The cap 222 is used for the protection of the recording head when it is out of recording or when the discharge recovery process is executed for the recording head. Also, the cap 222, a suction pump 223 which will be described later, and a blade 225 are arranged as one unit for a recovery system.

The discharge recovery process is a process (preliminary discharge) to remove air bubbles and dust particles or the ink overly viscose and no longer suitable for recording, which will cause defective discharges, by placing the cap 222 over the discharging port formation surface to discharge ink from the entire discharging ports by driving the elements arranged in the discharging ports to generate the energy which is utilized for ink discharge, and a process aside from the preliminary discharge is to remove the causes of the defective discharging by forcibly sucking ink for exhaust from the discharging ports while covering the discharging port formation surface with the cap 222.

The above-mentioned discharge recovery processes are executed by the instruction from the operator of the recording apparatus through the input units 1005 and 1006 which will be described later, or executed automatically at intervals of a given time. In this way, the ink discharge is kept in a good condition. The automatic discharge recovery process is mainly aimed at preventing any state that may disable recording from being encountered, which can possibly occur as the time elapses. The state that may disable recording is encountered when the supply of ink is interfered by the generation and development of residue of air bubbles, among others, in a recording head in which air bubbles are generated by the ingression of air into the ink passages in the head or foaming is created in ink for discharging it. In the present embodiment, the automatic discharge recovery process is executed immediately before starting a printing after 72 hours since the last discharge recovery process automatically performed.

A reference numeral 223 designates a pump which generates the suction force needed to forcibly exhaust ink, and is used for sucking the ink which is received by the cap 222 when the discharge recovery process is executed by such a forcible ink exhaust or by the preliminary discharge; and 224, an ink retaining member (exhaust ink tank) for storing the ink sucked by the pump 223. The exhaust ink tank 224 is connected to the pump 223 by a tube 228.

A reference numeral 225 designates a blade to wipe the discharging port formation surface of the recording head, which is supported in the position where the wiping is performed by extruding the blade to the recording head side in the dourse of process for which the carriage travels, and is movable to the reacted position where the blade does not engage with the discharging port formation surface; 226, a motor; and 227, a cam mechanism which receives the driving force transmitted from the motor 226 to drive the pump 223, and enable the cap 222 and the blade 225 to be shifted as required, respectively.

Figure 21:
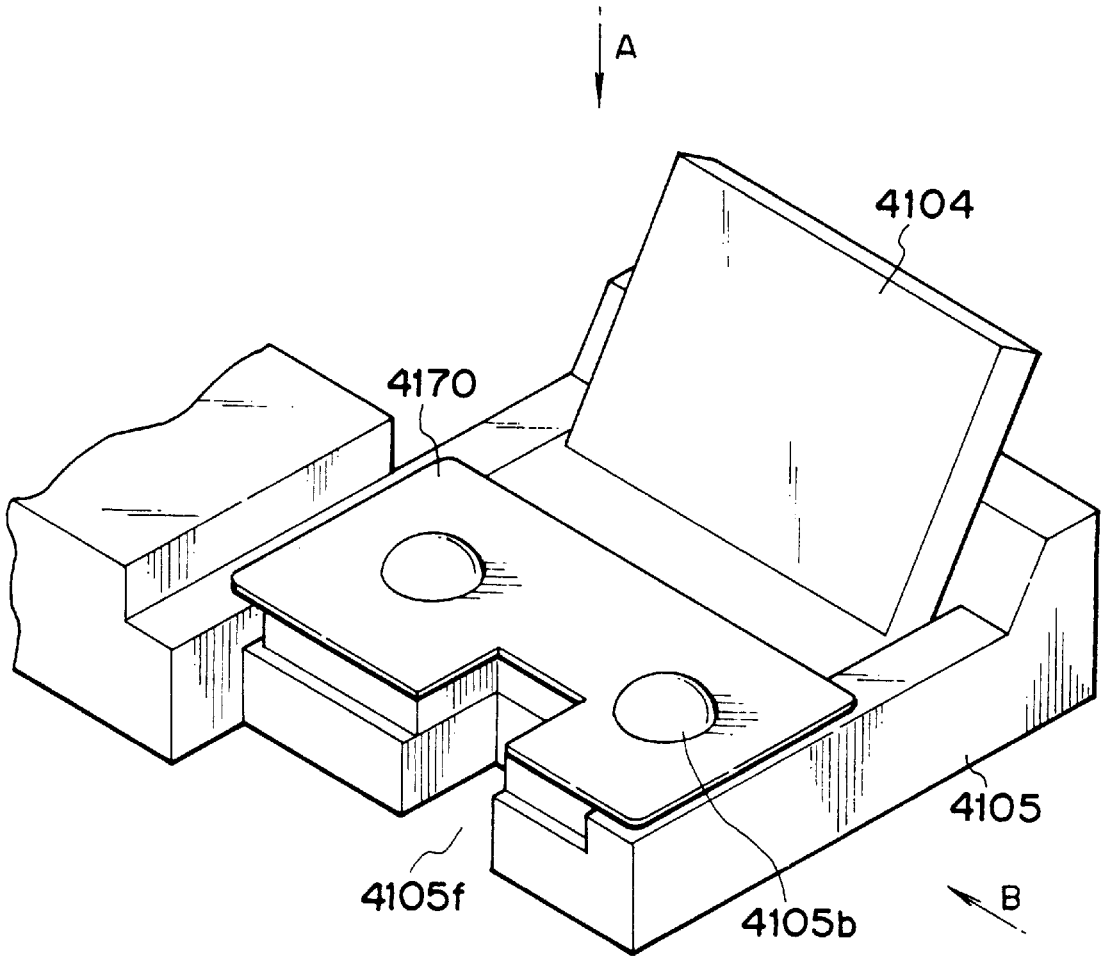
FIG. 21 is an enlarged perspective view schematically showing a blade unit.
Figure 22:
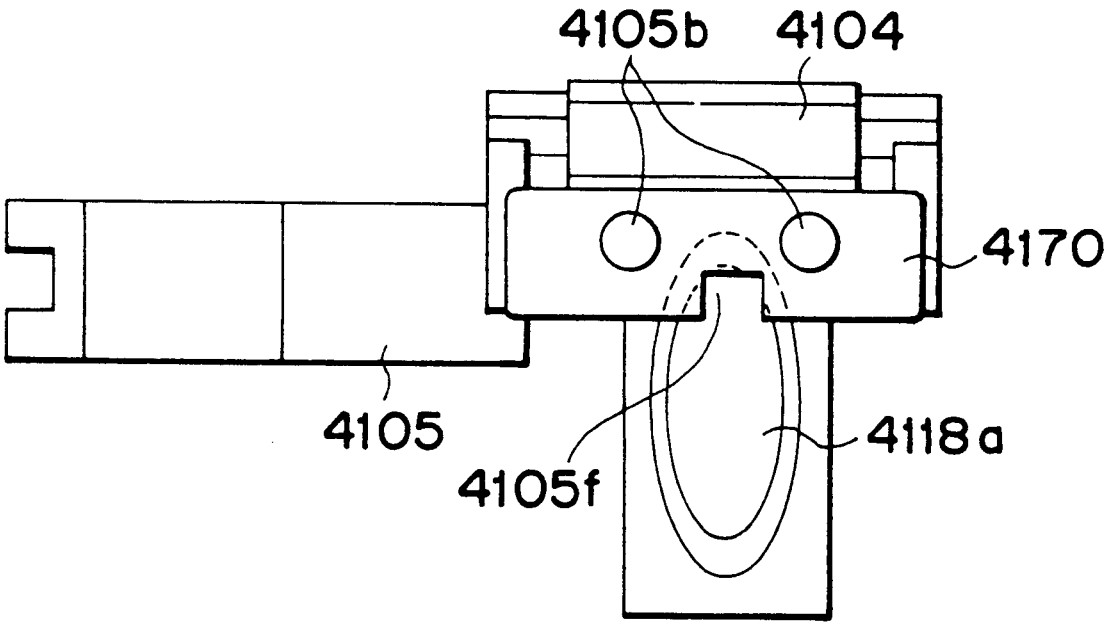
FIG. 22 is a plane view schematically showing the blade unit observed in the direction indicated by an arrow A in FIG. 21.
Figure 23:
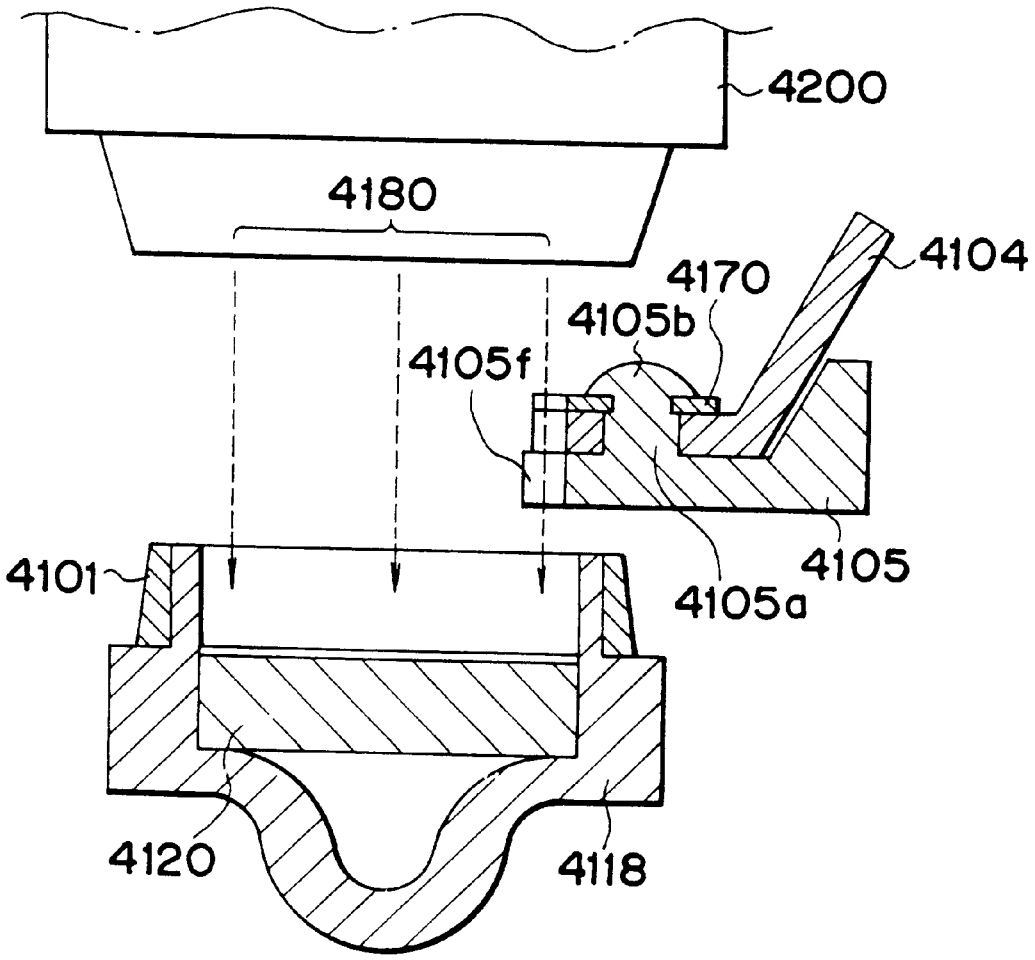
FIG. 23 is a plane view schematically showing the blade unit observed in the direction indicated by an arrow B in FIG. 21.

FIG. 21 is an enlarged perspective view showing the state of mounting a blade unit 4104 suitably used for an apparatus shown in FIG. 14 or FIG. 17 and FIG. 18 which will be described later. FIG. 22 is a plan view showing the positional relationship with a cap 4101 in the direction indicated by an arrow A in FIG. 21. FIG. 23 is an enlarged cross-sectional view showing the positional relationship between the cap 4101, recording head, and blade 4104 in the direction indicated by an arrow B in FIG. 21. The blade is made of a rubber such as hydrogenated nitrile butadiene rubber (HNBR) or urethane. The hole of the blade 4104 is fittingly coupled with the blade mounting shaft 4105*a* of a blade slider 4105, and then, after the blade holder 4170 made of a thin plate or the like is fittingly coupled with the extrusions 4105*b* of the shaft 4105*a*, the shaft 4105*a* is fixed by welding in order to prevent the blade holder 4170 from falling off. Here, the blade 4104 is shaped in a doglegged form by a formation processing. In this respect, a reference numeral 4120 designates an ink absorbent installed in the cap lever 4118.

Also, in order to execute the discharge recovery process for the head, the preliminary discharge is made from the discharging ports of the head 4200 into the interior 4118*a* of the cap lever 4118. FIG. 23 represents the positional relationship between the head 4200, blade 4104, and cap lever 4118 at this juncture. From the head, the ink designated by a reference numeral 4180 is discharged. Then a part of the ink 4180 is discharged through the cut-off 4105*f* of the blade slider 4105.

With the provision of the cut off 4105*f*, the blade slider 4105 can be arranged on the left side of the cut off, thus implementing the miniaturization of the apparatus.

Figure 2A:
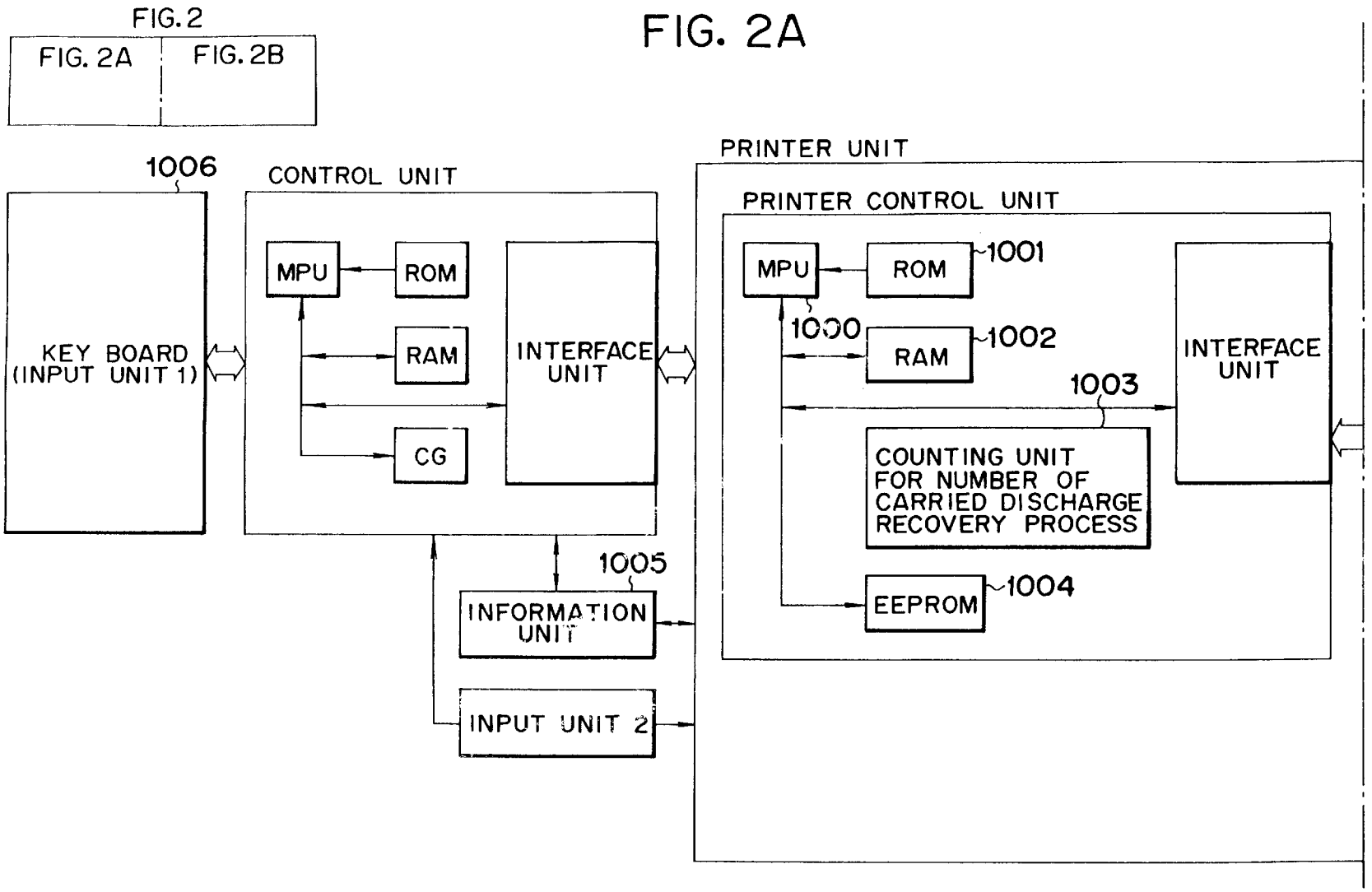
FIG. 2 is comprised of FIGS. 2A and 2B showing block diagrams which illustrate the ink jet recording apparatus represented in FIG. 1.
Figure 2B:
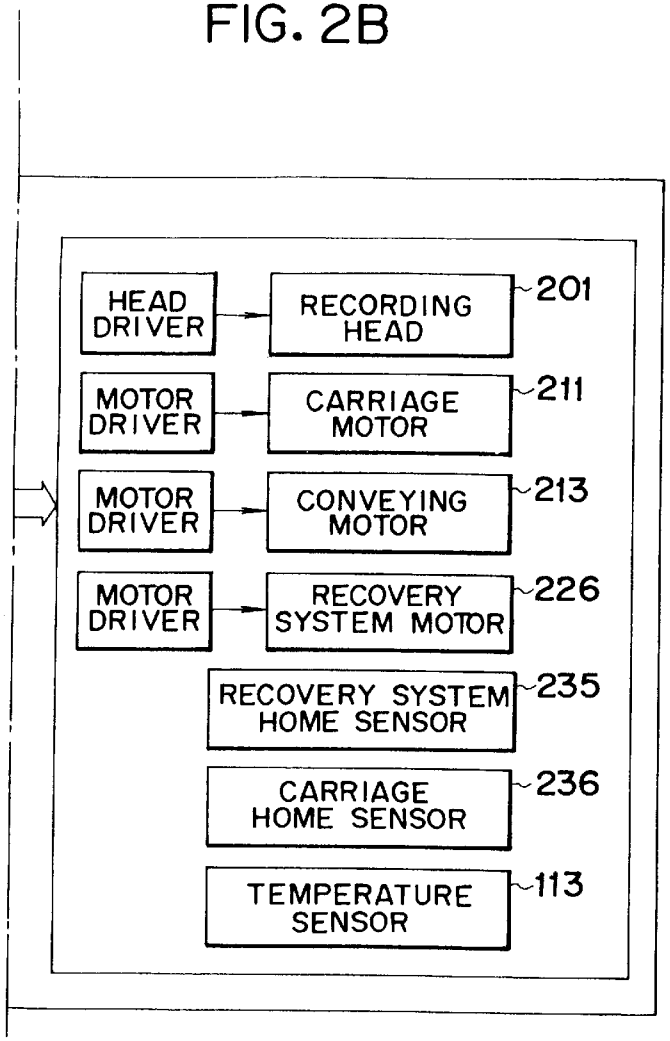

FIGS. 2A and 2B are block diagrams showing an example of the control system of the recording apparatus structured as has been described so far.

An arrangement is made to know the capping position and the traveling positions of the carriage on the basis of the detections made by a recovery system home sensor 235 and a carriage home sensor 236. In FIGS. 2A and 2B, a reference numeral 1000 designates a MPU to control each part by executing the control procedures such a prearranged program; 1001, a ROM storing the program and others corresponding to the contents of such control; 1002, a ROM used as a work area when the control procedures are executed; 1003, a unit for counting the number of discharge recovery operations, for example, to calculate the ink storage in the ink retaining member 224; 1004, an EEPROM which holds in a rewritable manner the number of the discharge recovery operations and the result of measurements of the calculated amount of ink storage and others, and is able to hold each of the data even when the power-supply to the recording apparatus is turned off; and 1005 and 1006, input units which enable the operator of the recording apparatus to instruct the execution of the discharge recovery process, and the actuation of the suction pump 223 in the unit of the recovery system, and the cap 222.

Regarding the present embodiment, the description will be made of the measurement method of the amount of stored ink in the ink retaining member (exhaust ink tank) 224 when the head cartridge for black ink use is mounted.

When the above-mentioned recording head is mounted, the ink conducted to the ink retaining member is the one which is exhausted to the cap 222 serving as an ink receptacle when a discharge recovery process is executed for the recording head. This is carried out by the suction operation of the ink exhaust mechanism (suction pump) 223 connected to the ink retaining member. Therefore, the ink conducted to the ink retaining member is the one discharged by the forcible suction for the discharge recovery process, and the preliminary discharge as well.

Figure 3:
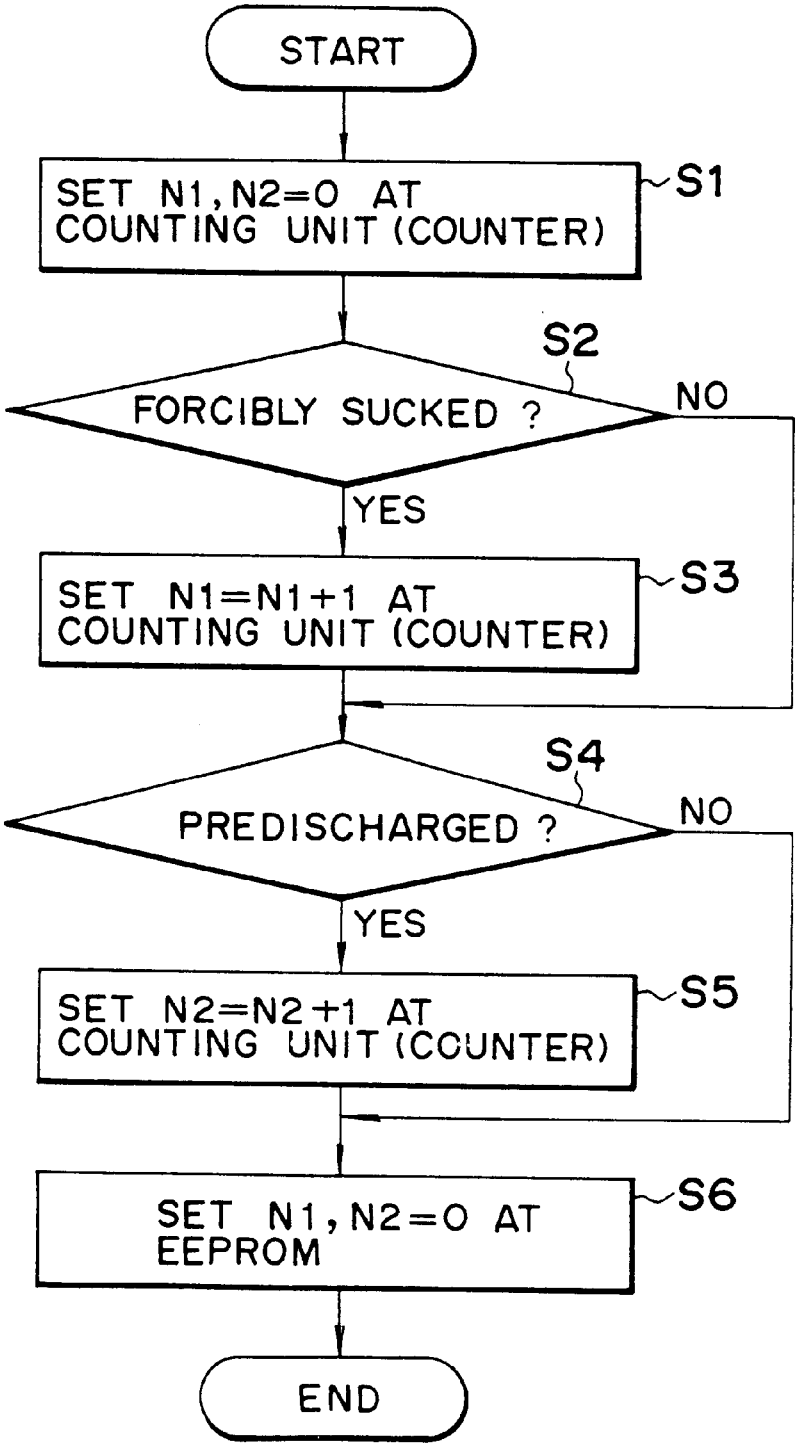
FIG. 3 is a view illustrating a method for measuring the ink stored according to a first embodiment.

Now, the method for measuring the amount of stored ink will be described in conjunction with FIG. 3.

Since the ink conducted to the ink retaining member results from the discharge recovery processes as described above, the number of executions of the discharge recovery process per instruction form the operator of the recording apparatus, and executions made at intervals of given time are divided by the measurement unit 1003 into the numbers N1 for the forcible suctions and the numbers N2 for the preliminary discharges to count each of the numbers.

When the counting is started, the numbers N1 and N2 of the counters in the measuring unit are reset to zero, respectively (step S1). Then, whether or not any forcible suction is executed is confirmed (step S2).

If the suction is executed, 1 is added to the N1 in the measurement unit (step S3), and then, whether or not any preliminary discharge is executed is confirmed (step S4). If it is confirmed that no forcible suction is made in the step S3, the process will proceed to step S4 without adding 1 to the N1 in the measurement unit. If it is confirmed that a preliminary discharge is executed in the step S4, 1 is added to the N2 in the measurement unit (step S5), and then, the process will be terminated (step S6) after holding the current values of the N1 and N2 in the holding unit 1004. Also, if no preliminary discharge is confirmed in the step S4, the process will proceed to step S6 and terminate it without adding 1 to the N2 of the measurement unit.

As an example of the holding unit 1004, an EEPROM capable of electrically erasing and writing are used to make it possible to hold the measured data as described above even when the power-supply to the recording apparatus is turned off. The counted number for the measurement unit is set at "0", for example, when the recording apparatus is delivered from the factory. Then, whenever the forcible suction or the preliminary discharge is executed after the operator has started using the apparatus, the counting is made so that the counting results are held in the EEPROM 1004 one after another. Since the number of executions is added to the EEPROM per execution of the discharge recovery process, the data on the EEPROM indicates the data on the total execution numbers up to that time. Therefore, by referring to the total execution numbers thus obtained, it is possible to measure the amount of stored ink according to the operational expression which will be described later.

Also, the data are held in the EEPROM. The total execution numbers of the discharge recovery process are held in it even when the power-supply to the recording apparatus is turned off.

Now, for example, the amount of exhausted ink from the recording head 201 is 0.1 g per forcible suction, the preliminary discharge is 100 shots per nozzle of the recording head while the discharging amount of one ink droplet is 80 ng. If this is executed by 64 nozzles, the amount of the exhausted ink is approximately 0.5 mg per preliminary discharge. On the other hand, the amount of stored ink which does not cause any ink leakage is 60 g for the ink retaining member (exhaust ink tank) 224, for example.

Further, the ink retaining member is partly structured by a cloth or a similar material which has a permeability which enables the stored ink to be evaporated into the atmosphere. The evaporated amount of the stored ink is 40% when the member is left intact under an environment of the high temperature and high moisture which make it difficult for the stored ink to evaporate, that is, at a temperature of 35° C. and moisture of 85% for a sufficiently long time, or the time until the ink becomes stable after the sufficient evaporation.

The method for using the ink jet recording apparatus according to the embodiments of the present invention is to deal with a long-time operation. Also, the amount of stored ink resulting from the head recovery and forcible suction operations is extremely small against the volume of the ink retaining member. Therefore, it is safe to consider that the ink is being evaporated at all times. With these in view, the ink storage capacity of the ink retaining member according to the present embodiment is set at 60/0.4=150 g in consideration of the amount of ink evaporation under the environment of the high temperature and high moisture. Another method for calculating the amount of evaporation is to obtain the amount of evaporation per unit time, and then, arrive at the amount of stored ink in accordance with the historical condition of uses. In this case, although the cost of manufacture is increased, the current amount of storage can be obtained more accurately.

Therefore, given the total execution numbers of the forcible suction as N1, and the total execution numbers of the preliminary discharge as N2, the amount of ink which can be stored without creating any ink leakage should be arrived at by the application of each of the total execution numbers N1 and N2 of the discharge recovery process which satisfies the following expression:

$$0.1\ \text{g} \times \mathbf{N1} + 0.5\ \text{mg} \times \mathbf{N2} < 150\ \text{g} \quad (1)$$

In the above expression, when the detected amount of storage is 149.9 g, for example, the expression is satisfied if the next discharge recovery process is a preliminary discharge. However, if it is a forcible suction, the storage amount reaches the upper limit. Therefore, it may be effective to set the value of the upper limit in advance at a value which is smaller than 150, namely, 145 as an example.

In this way, the total execution numbers N1 and N2 are counted, and then, when it becomes impossible to satisfy the enitre operational expressions, a warning is given from the warning unit 1005 to the operator of the recording apparatus.

Now, the description will be made of the case in which the amount of stored ink is calculated by correcting the measured value needed to calculate the stored ink in accordance with the mounting state of the carriage for the recording head according to the present embodiment.

At first, the description will be made of a method to recognize the state of the recording head 201 which has been mounted or yet to be mounted.

Figure 4:
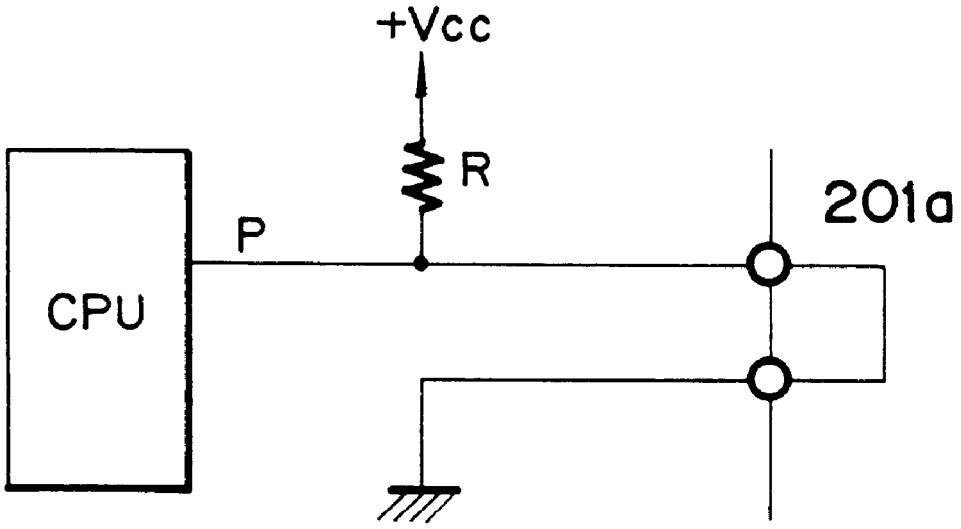
FIG. 4 is a view illustrating the detection of the mounting state of an ink jet cartridge according to the first embodiment.

FIG. 4 is a view showing an example of the control arrangement to enable the MPU 1000 to recognize the state of the recording head 201 which has been mounted or yet to be mounted. In the recording head, a signal line 201*a* is incorporated to confirm the (head cartridge) connection. Its one end is connected to the grounding of the main body controller through the EPC 206 while the other end is connected to the input port which enables the CPU to recognize "1" or "0", and also to one end of the resistor R. The other end of the resistor R is connected to the power-supply. In the above-mentioned structural example, when the MPU recognizes the value "1" carried by a signal from the input port, it is interpreted that the recording head 201 has not been mounted on the carriage as yet. If it recognizes the value "0", it is interpreted that the recording head 201 has already been mounted.

It is conceivable that the operator of the recording apparatus usually operates in a mode that the recording head 201 is mounted on the carriage 202 even in an event other than recording, but there are some cases that the recording head is detached from the carriage due to the complete exhaustion of ink in the recording head or due to some malfunction of the recording head which results in defective discharging conditions among others.

When the above-mentioned discharge recovery process is automatically executed, the detection of the amount of stored ink in the foregoing ink retaining member can be made without any particular problem if only the recording head 201 is mounted, but with no head being mounted, ink is not exhausted even if a discharge recovery process is executed, hence no ink flow to the ink retaining member. This leads to the creation of errors in detecting the amount of stored ink. Hence, despite the fact that there is still a considerable room in the ink retaining member to receive more ink for storage, a warning is issued eventually.

Further, in the state that no ink can be exhausted as in the case described above, the operation of the ink exhaust mechanism will bring about the same effect as in the case where the operator himself or some other means effectuates the ink exhaust in a condition that no ink can be exhausted from the recording head for the purpose to prevent colors from being mixed when the recording heads for different color ink should be used in the same recording apparatus.

Figure 5:
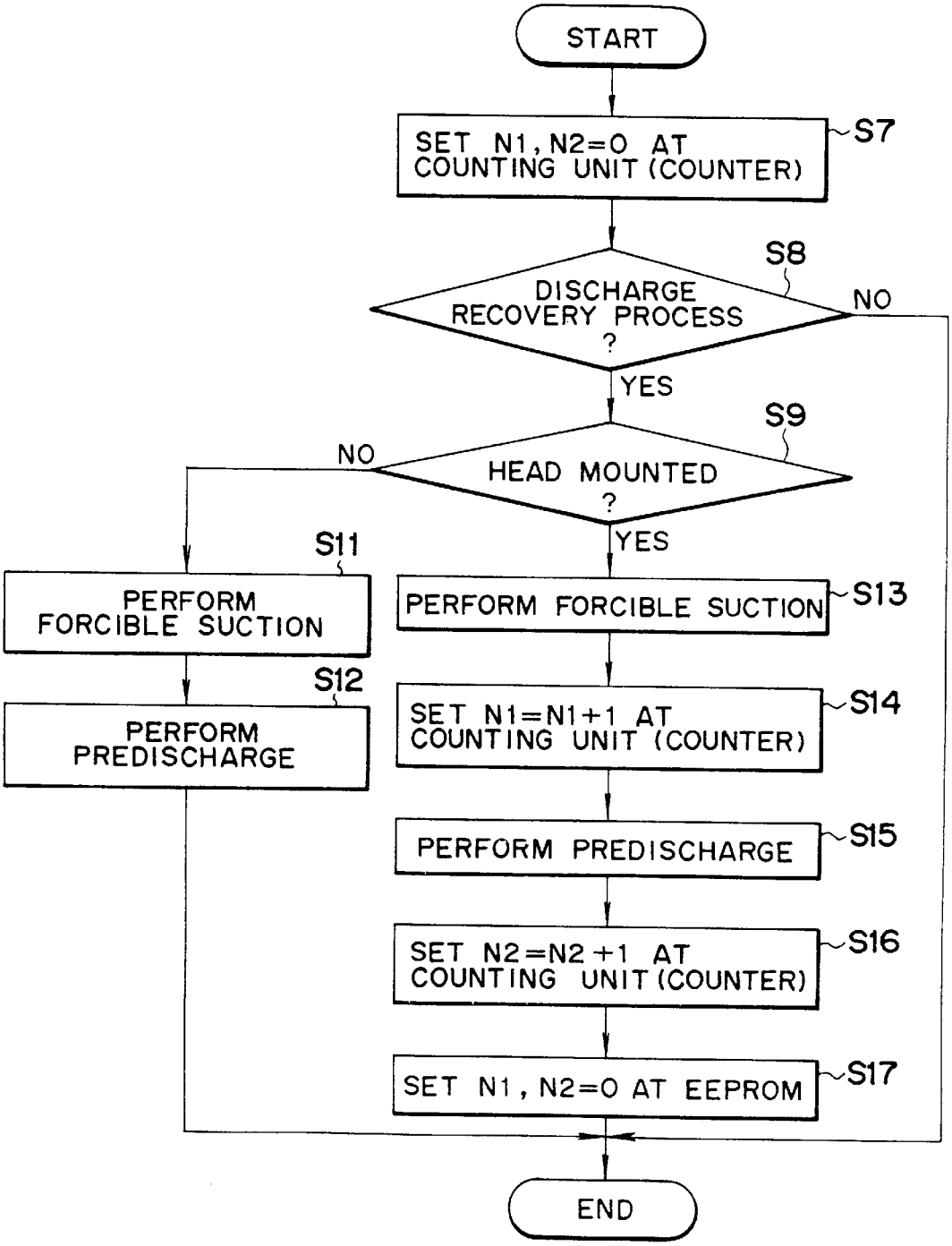
FIG. 5 is a view illustrating a method for measuring the ink stored according to a second embodiment.

FIG. 5 shows an example in which an improvement is made to solve the above-mentioned problems. When the counting begins, the aforesaid numbers N1 and N2 of the counters in the measurement unit are reset to "0", respectively (step S7). Then, whether or not any discharge recovery process should be executed is confirmed (step S8). If not, the process will be terminated. If a discharge recovery process should be executed, whether or not the head is mounted is confirmed (step S9). If no installation of head is confirmed in the step S9, a forcible suction and a preliminary discharge are executed without writing any number to the measurement unit (step S11 and S12), and then the process will be terminated. If an installation of head is confirmed in the step S9, a forcible suction is executed (step S13) and then, 1 is added to the N1 in the measurement unit (step S14). In continuation, a preliminary discharge is carried out (step S15), and then, 1 is added to the N2 in the measurement unit (step S16). Further, the current values of N1 and N2 are held in the holding unit 1004 (step S17), thus terminating the process.

As described above, in order to detect the current state of the recording head installation on the carriage immediately before the execution of the discharge recovery process, the detection is made in accordance with the control as described in conjunction with FIG. 5 (step S9). If the installation of the recording head is confirmed by this detection, the discharge recovery processes are executed (steps S14 and S16). After that, the results of the measurement are rewritten and held in the EEPROM which serves as the holding unit. In the EEPROM, the execution numbers are added per execution of discharge recovery process. Therefore, the data on the EEPROM indicates the total execution numbers up to that time.

In this way, it is possible to obtain the measured amount of exhausted ink to be stored in the ink retaining member in accordance with the foregoing operational expression on the basis of the total execution numbers of the discharge recovery processes thus held in the holding unit.

Also, if no installation of the recording head is confirmed, the numbers of forcible suction and preliminary discharge for the discharge recovery process are not counted even when the discharge recovery process is executed because no ink is discharged, that is, the ink exhaust mechanism (suction pump and preliminary discharge) is operated in the state that no ink can be discharged.

Here, the discharge recovery process is executed (steps S11 and S12) even when no installation of recording head is confirmed. This is a precaution which is taken in consideration of any disconnection of the signal lines 201*a* to confirm the recording head connection due to the inclusion of dust particles at its contacting points to the main body controller.

Like this, the state of the recording head which has been mounted or yet to be mounted is detected or at least the state of the ink tank which has been mounted or yet to be mounted is detected when the recording head and the ink tank are separate and replaceable individually. Then, a correction is made by not counting any number of ink exhaust executed by the discharge recovery process without the installation of the recording head (or ink tank). In this way, it is possible to count the storage numbers of ink to the ink retaining member exactly, that is, to obtain the total amount of stored ink.

Also, in the present embodiment, since the installation of the recording head is detected immediately before the discharge recovery process, it is possible to recognize the presence or absence of the recording head exactly when any discharge recovery process is executed.

Furthermore, the discharge recovery process is executed even when the recording head is yet to be mounted eventually. Therefore, even if the absence of the recording head is erroneously recognized due to such defective connection of the signal line to confirm for recording head connection to the controller for the recording apparatus, the recording head can be maintained in a dischargeable state.

In the present embodiment, to detect the value of the upper limit of the ink storage is used as a timing to issue a warning, but it may be possible to adopt a given volume X which is lower than the value of the upper limit which is arrived at by the operational expressed given below, and to inform the estimated amount of stored ink:

$$0.1\ \mathrm{g} \times \mathbf{N1} + 0.5\ \mathrm{mg} \times \mathbf{N2} < Xg \qquad (2)$$

Moreover, it may be possible to inform the estimated amount of stored ink at any time within a range which is less than the upper limit of ink storage.

(Second Embodiment)

Now, regarding a recording apparatus capable of mounting the recording head cartridge for color use 201C which is in the same mode as the recording head cartridge 201 for black ink, the description will be made of an embodiment in which the present invention is applicable to the event that the ink exhaust mechanism is actuated in a state that no ink can be automatically exhausted from the recording head when detecting the replacement of the above-mentioned recording heads, and having detected such a replacement.

In a recording apparatus using the above-mentioned recording head for black ink 201, the operator replaces it with a recording head for color use 201C (not shown) and installs the latter on the carriage 202 for a color recording as required.

In a case that the recording head for color use 201C is installed, the cap to be used is also the aforesaid cap 222 which is used for the recording head for black ink. As a result, the black ink adhering to the cap tends to be transferred to the recording head for color use when the cap abuts upon the head which has been replaced. This may result in mixing colors in the intended color recording. Such a color mixture is conspicuous when there is a considerable ink residue in the cap due to the imperfect induction of the ink exhausted by a discharge recovery process to the ink retaining member 224.

To counteract this in the present embodiment, the replacement of recording heads is detected for the purpose to induce the ink residues in the cap and others perfectly to the ink retaining member 224, and the structure is arranged to execute a forcible suction operation without allowing the cap 222 to abut on the recording head when any replacement of the heads is detected.

As an example, the detection of the recording head replacement is made by measuring the period of time during which no head is installed. If no installation of a head is detected for a regulated period of time, more than five second as an example, it is determined that the head currently in use will be replaced with another recording head including the one for color use.

Now, in conjunction with FIG. 6, the description will be made of the case where the number of forcible suctions is counted in accordance with the detected result of the recording head replacement, and then, the measurement of stored ink is obtained after correcting the foregoing counted value.

When a counting begins, the above-mentioned numbers N1 and N2 of the counters in the measurement unit are reset to "0", respectively (step S18). Then, the installation of the head is confirmed (step S19). If installed, a forcible suction is carried out (step S20), and then, the process will be terminated. If not installed, whether or not the discharge and suction operations should be carried out is confirmed (step S21). If not executed, the process will be terminated. If executed, after carrying out the forcible suction (step S22), 1 is added to the N1 in the measurement unit (step S23) and in continuation, after executing a preliminary discharge (step S24), 1 is added to the N2 in the measurement unit (step S25). Further, the current values of N1 and N2 are held in the holding unit 1004 (step S26), thus terminating the process.

In the above-mentioned operation, when the recording head replacement is detected, there is no counting of the number of forcible suction carried out (S20) in the state that the head is yet to be mounted, which is executed in order to prevent any color mixture from occurring in a color printing. Since this suction is operated while the recording head is not mounted, no ink is exhausted from the recording head, but the ink residue in the cap is exhausted. Even if there is any ink residue in the cap, the amount of such an ink residue exhausted is substantially negligible, and also, as there is a mixture of the event that the ink residue is present and that it is not present sometimes, the number of ink exhaust in this particular case is not counted.

When a discharge recovery process is carried out without any prediction of the recording head replacement, it is determined that such a discharge recovery process is to be executed in the usual state, that is, a recording head is mounted. Thus the forcible suction and preliminary discharge are carried out (steps S22 and S24), and its numbers are counted (steps S23 and S24). At this juncture, the result of counted numbers are held in the EEPROM after having rewritten the data on the counting results up to that time (step S26).

In this way, when the ink exhaust mechanism is actuated in the state that does not allow any ink exhaust to be carried out as in the case of the first embodiment, it is possible to calculate the exact amount of stored ink by correcting the counted numbers for measuring the amount of ink to be stored. Further in the present embodiment, the replacement of the recording heads for color use is detected, and then, the ink in the cap is exhausted before the recording operation by the recording head which will be used after replacement, hence making it possible to prevent and minimize the color mixture in the intended printing in color.

According to the above description, the forcible suction is carried out in a state that no recording head is mounted, but if the detected period of time for the absence of the recording head is longer than a given period, it may be possible to adopt a structure wherein the cap 222 is retracted to the position where it does not abut on the recording head, and then, a forcible suction is executed whenever the installation of a recording head is detected. Further, if the detected period of time for the absence of the recording head is longer than a given period, it may be possible to adopt a structure wherein the cap 222 is retracted likewise, and then, a forcible suction is executed when the installation of a recording head is detected.

Also, when an ink exhaust operation is carried out in the state that no ink exhaust is possible from the recording head, and the amount of exhausted ink in the cap is not negligible, it may be possible to measure the ink to be exhausted from the cap by counting the number of the forcible suctions after weighting a to it as shown in FIG. 6B subsequent to the step S20 shown in FIG. 6A.

Further, when the prediction of a recording head replacement is detected, only the forcible suction is operated, but this may be substituted by a series of sequences to carry out a discharge recovery process including the preliminary discharge. Selection of these operations can be made arbitrarily depending on the size of the apparatuses and kinds of ink to be used. Also, in a case of the recording head and the ink tank being separate and replaceable individually, it is more effective to employ the same structural control when replacing only ink tanks.

(Third Embodiment)

Now, the description will be made of an embodiment wherein the present invention is applicable when a recording head of the same mode but different kind is mounted on the same recording apparatus.

In the present embodiment, a head of different kind is the one having the characteristics which are particularly different with respect to its ink exhaust: for example, a recording head having the different sizes of ink droplets; a recording head whose ink droplets are the same in its size, but which has different numbers of discharging ports, thus the amount of exhausted ink being different despite the execution of the same preliminary discharge; or a recording head whose amount of exhausted ink is different when a forcible suction is carried out due to the different loads on its ink tank, different resistances to the ink flow passages, different viscosities of ink, or the like. When these heads having different characteristic properties are used, the amount of exhausted ink by the discharge recovery process is caused to vary. Hence it is not appropriate to apply the operational expressions described in the foregoing embodiments as they are. In the present embodiment, therefore, identification signal lines 121*a*, 121*b*, 121*c*, and 121*d* are provided as shown in FIGS. 7A and 7B to make it possible to discriminate the differences in the recording heads, and then the -structure is arranged to obtain the total amount of exhausted ink by the application of the following expression in the same manner as the foregoing operation after having obtained the amount of exhausted ink by one discharge recovery process per the recording head having different characteristic properties:

$$A1g \times N1 + A2g \times N2 \quad (3)$$

where the A1 and A2 are the amount of exhausted ink by the execution of a forcible suction, and the amount of exhausted ink, respectively, by the execution of a preliminary discharge in the recording head which differs from the recording head described in the first embodiment, and the N1 and N2 are the total execution number of forcible suctions, and the total execution number of preliminary discharges, respectively.

Figure 7A:
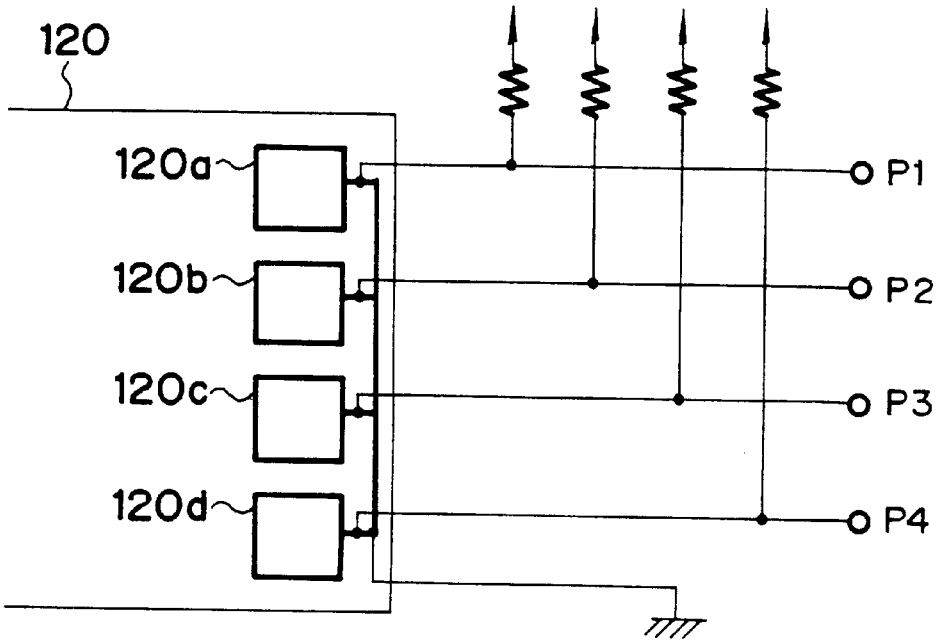
FIGS. 7A and 7B are views illustrating a detection unit according to a third embodiment to distinguish the kinds of ink jet cartridges including a recording head whose characteristic properties are different.
Figure 7B:
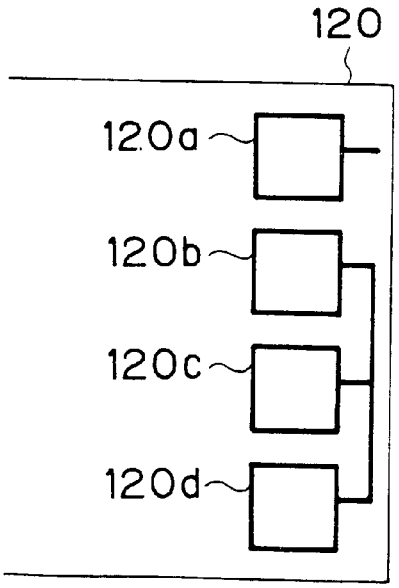

FIG. 7A is a view showing the connection between a printed-circuit board 120 and the FPC 206 of a recording head. The identification lines 121*a* to 121*d* provided for a pad 121 are the electrical contacting points with the FPC 206.

FIG. 7A is a basic type for identifying the kinds of recording heads. Through the FPC 206, each end of the identification lines is connected to the power-supply through a resistor, and at the same time, connected to each of the input ports P1, P2, P3, and P4 of the MPU 1000. These lines share a grounding. In this case, the identification signals become 0, 0, 0, and 0 from the one at 121*a* in that order (here, 0 indicates the GND level).

FIG. 7B shows a case of a recording head having different characteristic properties from those of the basic type recording head. Only the grounding pattern of the identification signal at 121*a* is cut off. In this case, the identification signals become 1, 0, 0, and 0 (here, 1 indicates a level of +5V).

Now, in conjunction with FIG. 8, the description will be made of an embodiment wherein the present invention is applicable when the kinds of recording heads are identified in such a manner as above.

In the present embodiment, two kinds of recording heads, kind 1 and kind 2, are used. The kind 1 and kind 2 recording heads are such that compared to the kind 1, the viscosity of ink used for the kind 2 is low, for example, and as shown in Table 1, the amounts of exhausted ink are different for the same forcible suction and preliminary discharge.

TABLE 1

| | A1 (Exhausted amount per forcible suction) | A2 (Exhausted amount per preliminary discharge) |
|---|---|---|
| Kind 1 | 0.10 g | $0.50 \times 10^{-3}$ g |
| Kind 2 | 0.15 g | $0.50 \times 10^{-3}$ g |

When a counting begins, the above-mentioned numbers N1 and N2 of the counters in the measurement unit are reset to "0", respectively (step S27). Then, it is confirmed (in steps S28 to S30) whether or not any discharge recovery process should be carried out; whether or not heads are mounted; and if mounted, what kinds, among others.

In each of the above-mentioned steps, if it is confirmed that no discharge recovery process is executed, the process will be terminated, and if it is confirmed that a discharge recovery process should be carried out, but no heads are installed, the required discharge recovery process is executed (step S29), then the process will be terminated.

If the heads are installed and the kinds are also identified, the required discharge recovery process is carried out (steps S31 and S35), and then, N1=1, and N1=1 are set in the measurement means, respectively (steps S32, S33, S36, and S37), and then, the amounts of exhausted ink corresponding to the kinds of heads are obtained by referring to the table (step S34, and step S38).

Here, the amount of exhausted ink k per kind is obtained by the operational expression (3) (step S40). The amount of exhausted ink K held in the EEPROM up to that time is read out (step S41). To the K thus read, the k is added and written in the EEPROM (step S42), then the process will be terminated.

As described above, in the present embodiment, when the execution of the discharge recovery process is instructed, the kinds of the recording heads are identified by the above-mentioned identification lines at first (step S30). After the identification of the kinds of the recording heads, the discharge recovery processes are carried out (steps S31 and S35). Then the numbers N1 of the forcible suction and the numbers N2 of the preliminary discharge for the discharge recovery processes are counted (steps S32 and S33, S36, and S37). To measure the amount of exhausted ink by the discharge recovery processes as above, the amounts of exhausted ink A1 and A2 are obtained for each of the recording heads (steps S34 and S38) by referring to a table in which the amount of exhausted ink per discharge recovery process is arranged as in the Table 1 for each kind of the recording heads. In this way, it is possible to obtain the amount of exhausted ink k by the current discharge recovery process by the application of the foregoing operational expression in step S40 on the basis of the kind of the recording head and the numbers of forcible suctions N1 and the number of preliminary discharges N2 as well as the amounts of exhausted ink A1 and A2 per discharge recovery process corresponding to the kinds of the recording heads obtained in such a manner as above.

Here, the amount of exhausted ink k thus obtained is added to the results of measurement K of the ink which has been exhausted by the discharge recovery processes and stored in the ink retaining member up to that time (step S41), and then, the result of such addition is written and held in the EEPROM 1004 (step S42). Since the result of measurement K of the aforesaid ink is obtained by adding the amount of stored ink K in the ink retaining member up to that time and the amount of exhausted ink by the current discharge recovery process, the measurement eventually presents the total amount of stored ink including the amount of ink currently exhausted. In this description, when a discharge recovery process is executed for the first time, the result of measurement of ink storage K held in the EEPROM is "0", which is represented as K=k.

In this way, therefore, even when the amount of exhausted ink by the discharge recovery process varies due to the different kinds of recording heads, it is possible to obtain the total amount of stored ink by exactly measuring the total amount of stored ink in the ink retaining member in such a manner that the kinds of recording heads are identified each time the discharge recovery process is carried out; the amount of exhausted ink is corrected in accordance with the kinds of the recording heads; and the amount thus corrected is added to the result of ink measurement up to the last time in order to keep the updated amount in the data holding unit even when different kinds of recording heads are used while being replaced with each other.

As a result, the present embodiment is effectively and suitably applicable to the case where the characteristics of ink exhaust in the recording heads for color use are different per color as an example.

Also, it is possible to apply the present embodiment in combination with the above-mentioned first and second embodiments, which have been described so far, by arranging a structure or some other means so that the ink exhaust numbers are not counted because the ink exhaust is not carried out when the kind of the recording head is different, and also, no recording head is installed as shown in the steps S29 and S39.

(Fourth Embodiment)

Now, the description will be made of an embodiment in which the amount of stored ink in the ink retaining member is measured by modifying the operation of the above-mentioned discharge recovery process in accordance with the kinds of the recording heads, and by obtaining the amount of exhausted ink in accordance with the discharge recovery process thus modified when the recording heads of different kinds are used in one and the same recording apparatus as in the case of the third embodiment.

In the present embodiment, two kinds of recording heads, kind 1 and kind 2, are used. The recording heads of kind 1 and kind 2 are those having different sizes of the common liquid chambers of the rerecording heads in which the ink to be discharged from the discharging ports is retained, and also having the ink supply tubes for supplying ink from the ink tank to the common liquid chamber, the diameters of which are different. Compared to the kind 1, the kind 2 is larger in its structure. Regarding the amount of discharged ink, however, both heads are arranged so that the same amount of discharged ink can be obtained. The forcible suction operation for the above-mentioned discharge recovery process is mainly aimed at reproducing or maintaining a good condition of discharging by removing the ink which has become overly viscous and no longer suitable for ink discharging and air bubbles in the discharging ports, ink passages in the vicinity of the discharging ports, and in the ink liquid chamber. Furthermore, this operation has a significant objectives of conducting ink from the ink supply member, such as an ink tank, to the discharging ports in order to resume the ink supply when the ink supply should be suspended due to the break down of meniscuses at the discharging ports, the development of air bubbles in the ink passages, or some other unfavorable events. To achieve these objectives, the structure is arranged in the present embodiment so that the amount of exhausted ink per forcible suction is substantially equal to the amount of ink filled in a portion from the above-mentioned ink supply tube to the discharging ports.

Figure 9A:
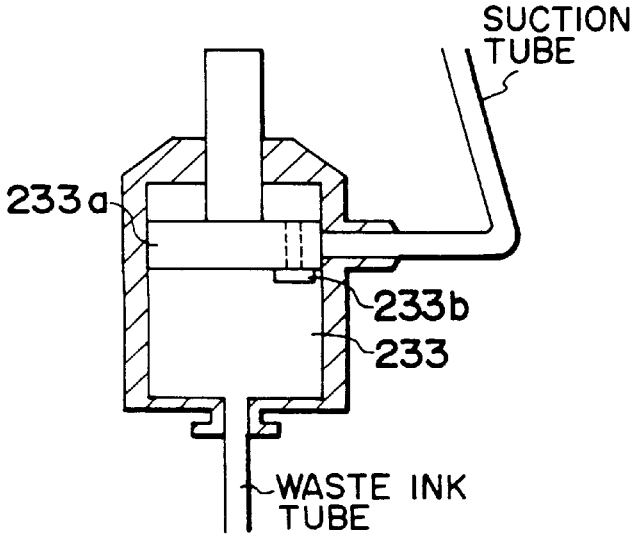
FIGS. 9A to 9D are views illustrating the operation of an ink exhaust mechanism arranged for the recording head of a different kind according to the third embodiment.
Figure 9B:
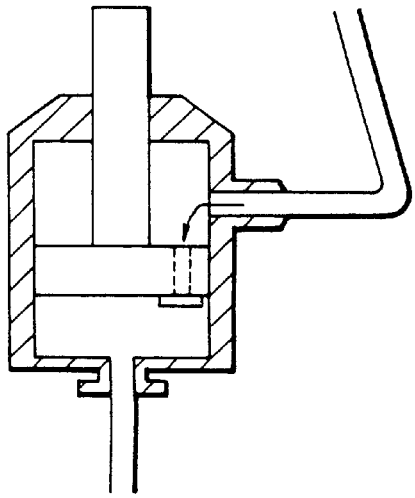
Figure 9C:
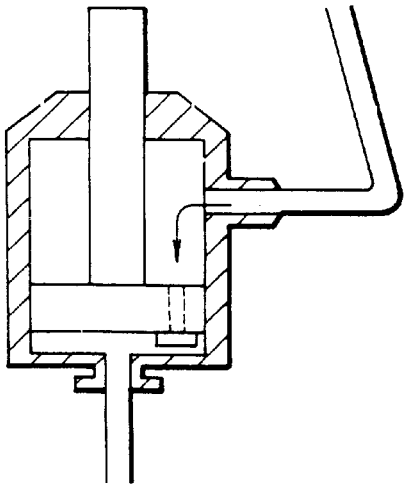

Therefore, it is appropriate to make the amount of exhausted ink per forcible suction greater for the kind 2 recording head than that of the kind 1 because the kind 2 has a large volume after the above-mentioned ink supply tube. To attain this arrangement in the present embodiment, the kinds of the recording heads are identified, and as shown in FIGS. 9A to 9D, the forcible suction is carried out in accordance with the kind thus identified. FIGS. 9A to 9D are views illustrating the operation of a suction pump to materialize such a forcible suction. FIG. 9A represents the state that no suction operation is executed. FIG. 9B shows the forcible suction operation for the kind 1 recording head by traveling a piston 223*a* in the direction indicated by an arrow A to exhaust ink. FIG. 9C shows the forcible suction operation for the kind 2 recording head.

Figure 9D:
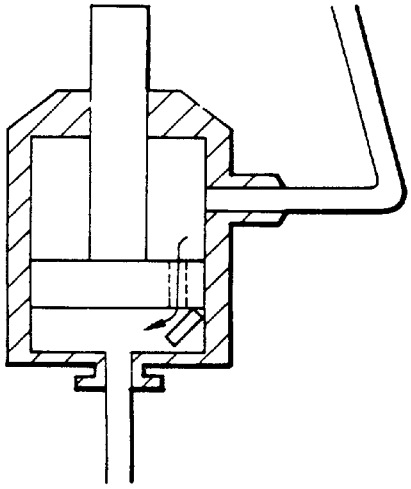

Also, FIG. 9D shows the state that the ink in the suction pump is being exhausted after the execution of the ink suction, in which a valve 223*b* opens in the process of the operation to travel the piston 223 in the direction indicated by an arrow B to exhaust ink. Here, when the forcible suction is carried out for the kind 2 recording head, the piston is traveled to a position which is lowered still more as shown in FIG. 9C to make it possible to exhaust ink in a amount more than that for the kind 1 recording head shown in FIG. 9B; hence the achievement of the above-mentioned purpose of the forcible suction.

Figure 8:
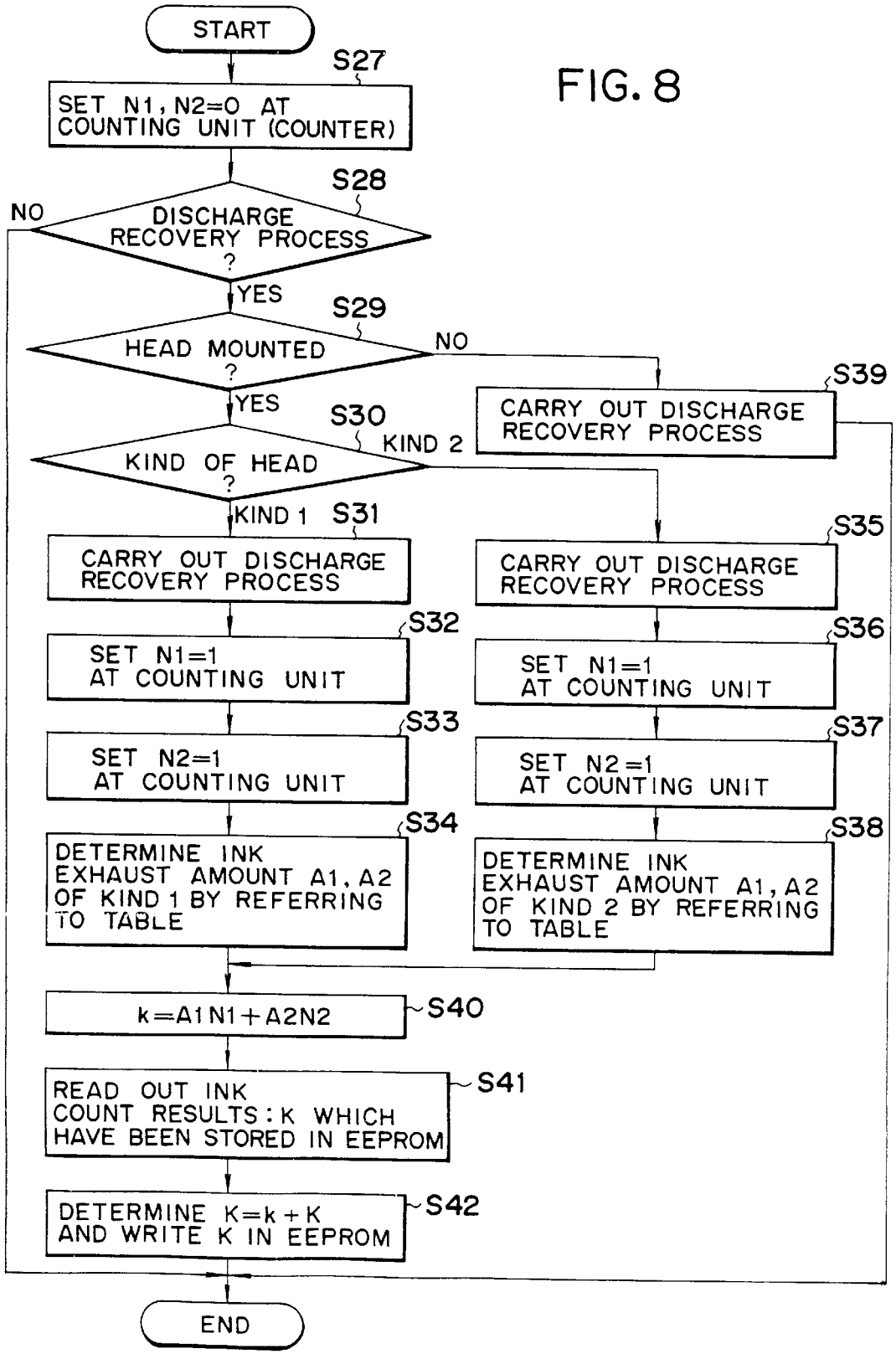
FIG. 8 is a view illustrating a method for measuring ink stored according to the third embodiment.

When an optimal discharge recovery process is carried out like this by changing the forcible suction operations in accordance with the kinds of recording heads, the discharge recovery processes in the steps S31 and S35 in FIG. 8 are executed by the discharge recovery processes corresponding to each of the recording heads shown in FIGS. 9A to 9D thereby to calculate the measured amount of ink to be stored in the ink retaining member by the application of the present invention. Further, a table is provided by obtaining the amounts of exhausted ink for each of the recording heads as in the case represented by the formation of the Table 1. Then, it becomes possible to apply the same control as in the third embodiment for the measurement of the amount of stored ink in the ink retaining member.

In this way, it is possible to measure the total amount of ink stored in the ink retaining member by measuring the amount of exhausted ink for each of the recording heads after correction even when the kinds of recording heads are different, the operations of discharge recovery processes and others for each of the recording heads are changed, and the amounts of exhausted ink are varied.

Also, in the present embodiment, if it is desired that an ink exhaust should be executed for the discharge recovery process in an amount greater still, a counter-measure may be such that the above-mentioned number of forcible suctions are increased in a series of the discharge recovery processes as a possible means. In this case, such a counter-measure can be arranged by setting 2 or more to the number of forcible suctions N1 as represented in the steps S32 and S26 in FIG. 8.

(Fifth Embodiment)

Now, the description will be made of a correction method as another embodiment according to the present invention, in which a correction is made in accordance with the ambient temperatures in order to calculate the amount of stored ink more accurately.

As has been described so far, the ink conducted to the ink retaining member is the one exhausted by the discharge recovery process. On the other hand, due to changes in the viscosity of ink and others, the amount of exhausted ink may vary even for the same recording head.

Figure 10:
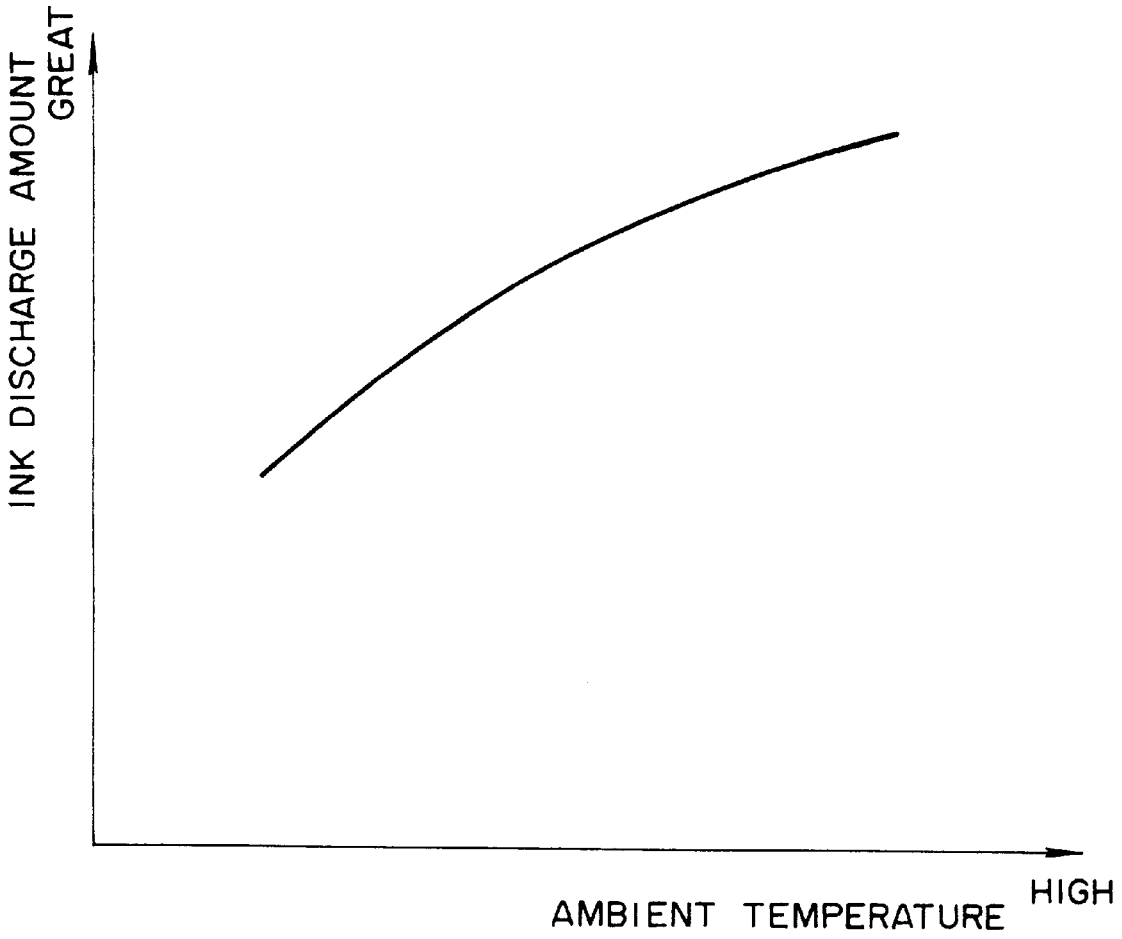
FIG. 10 is a conceptual view showing the relationship between the ambient temperatures and the amounts of ink discharge according to a fifth embodiment.

As an example which may affect the amount of exhausted ink to vary most easily in the same recording head, change of ambient temperatures can be named. FIG. 10 represents the variation of the amount of discharged ink which is discharged corresponding to the changes in the ambient temperature. Here, the discharged amount means the average value of the weight of one ink droplet discharged from one discharging port, which is approximately 50 ng at an ambient temperature of 10° C. and approximately 90 ng at an ambient temperature of 30° C., for example.

Figure 11:
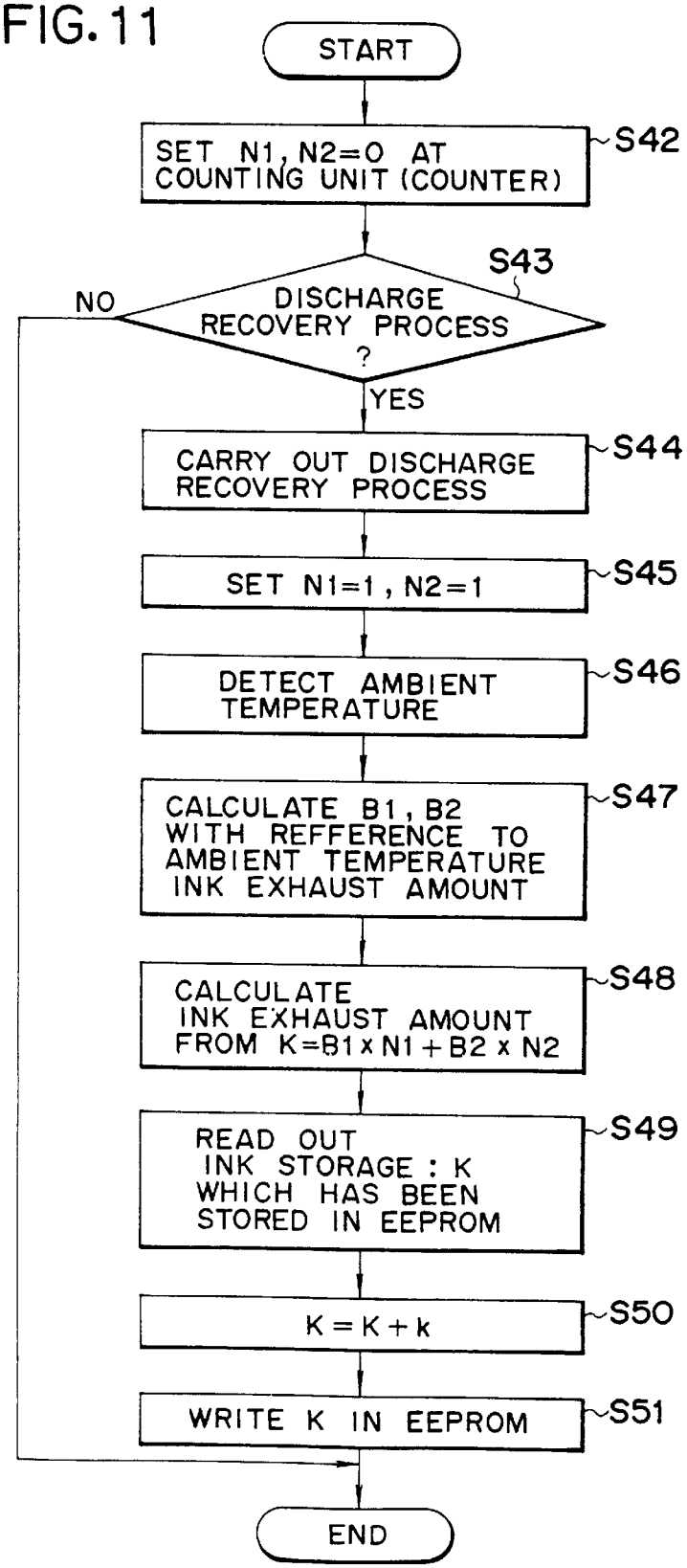
FIG. 11 is a view illustrating a method for measuring ink stored according to the fifth embodiment.

Now; in the present embodiment, as a specific method to detect the ambient temperatures around the recording head each time a discharge recovery process is carried out, a structure is arranged to provide a temperature sensor 113 shown in FIGS. 2A and 2B and a table in which the amount of exhausted ink for the discharge recovery process is defined per ambient temperature as shown in Table 2, thus enabling the amount of stored ink to be measured by the application of the following operational expression in accordance with the ambient temperature detected the foregoing sensor: in this respect, FIG. 11 is a view showing this state, and FIG. 10 is a table showing an example of the amounts of exhausted ink corresponding to the ambient temperatures:

$$k = B1g \times N1 + B2g \times N2 \quad (4)$$

where the B1 and B2 are the amounts of exhausted ink by the forcible suction and preliminary discharge, which are obtainable per ambient temperatures shown in FIG. 10, respectively, and the N1 and N2 are the results of counting of the execution numbers of the forcible suction and preliminary discharge.

TABLE 2

| Ambient temperature | Amounts of exhausted ink by forcible suction B1 | Amount of exhausted ink by preliminary discharge B2 |
|---|---|---|
| less than or equal to 5° C. | 0.05 g | $0.20 \times 10^{-3}$ g |
| 6–15° C. | 0.08 g | $0.35 \times 10^{-3}$ g |
| 16–25° C. | 0.10 g | $0.50 \times 10^{-3}$ g |
| 30–35° C. | 0.13 g | $0.60 \times 10^{-3}$ g |
| more than or equal to 36° C. | 0.13 g | $0.62 \times 10^{-3}$ g |

Now, with reference to a flowchart shown in FIG. 11, the description will be made of the flow of calculation to obtain the amount of stored ink according to the present embodiment.

When a counting begins, the above-mentioned numbers N1 and N2 of the counters in the measurement unit are reset to "0", respectively (step S42). Then whether or not any discharge recovery process is executed is confirmed (step S43). If negative, the process will be terminated. If affirmative, a discharge recovery process is carried out (step S44), and then, N1=1 and N2=1 are set, respectively, in the measurement unit (step S45). In continuation, the ambient temperature is detected (step S46), and by referring to the table, the amount of exhausted ink is obtained in accordance with the detected ambient temperature (step S47).

Here, the amount of exhausted ink k is obtained by the application of the operational expression (4) per ambient temperature (step S48). The amount of stored ink K which has been held in the EEPROM up to now is read (step S49). The k is added to the K thus read (step S50), and the result is written in the EEPROM (step S51). The process will be terminated.

As described above, in the present embodiment, the numbers of forcible suction and preliminary discharge executed for the discharge recovery processes are obtained to measure the amount of stored ink at first (S45). Then, the temperature of the recording head is detected (S46), and by referring to the table represented in FIG. 14 to show the relationship between the ambient temperatures and the amounts of exhausted ink, namely, the representation of the amounts of exhausted ink which are corrected according to the ambient temperatures, the amounts of exhausted ink B1 and B2 are obtained (S47). The amount of exhausted ink k at this juncture is calculated by the application of the above-mentioned operational expression (S48). In the EEPROM, the updated result of measurement K of the amount of stored ink to the last time is held. This amount of measurement K is read out, to which the amount of exhausted ink k for the current discharge recovery process is added to calculate the total measurement K of the amount of stored ink (S50). This result of the total measurement is again written in the EEPROM to update its holding (S51). In this respect, the B1 stands for the amount of exhausted ink per forcible suction; the B2, the amount of exhausted ink per preliminary discharge; the k, the amount of exhausted ink for the current discharge recovery process; and the K, the amount of exhausted ink by the discharge recovery processes up to last time, that is, the amount of stored ink.

With the structure arranged as above, the ambient temperature of the recording head is detected each time discharge recovery process is carried out to correct the amount of exhausted ink corresponding to the detected temperature for measurement, hence making it possible to measure the amount of exhausted ink accurately. Furthermore, the structure is arranged to add the current measurement result and the amount of exhausted ink measured up to last time per execution of the discharge recovery process, as well as to hold the result of such addition, thus enabling the total measurement of the amount of stored ink to be calculated exactly, that is, making the exact measurement of the total amount of stored ink possible.

Figure 12A:
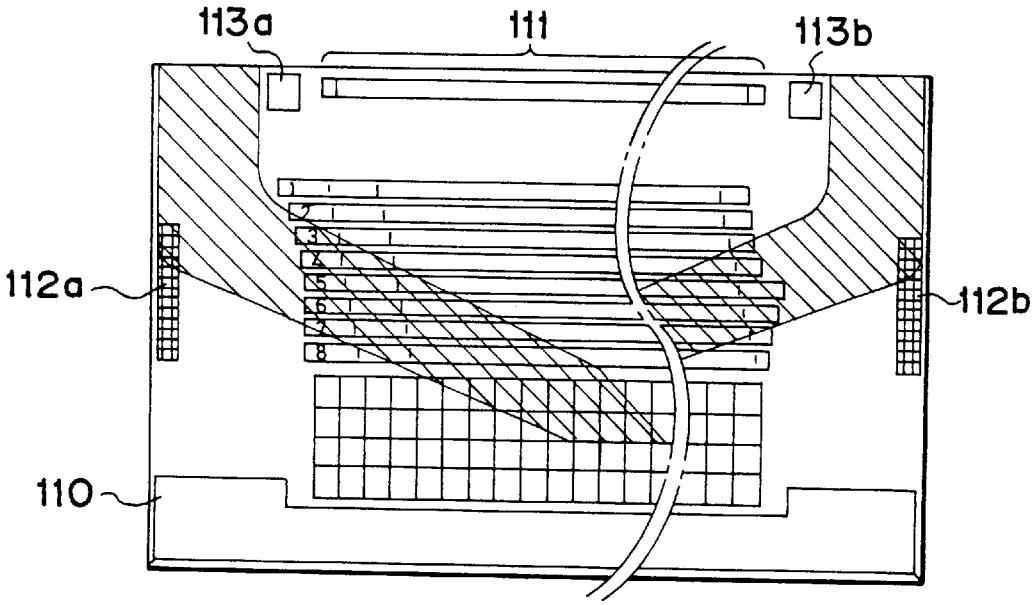
FIGS. 12A and 12B are views illustrating a temperature sensor of the temperature detection unit of a recording head according to a sixth embodiment.
Figure 12B:
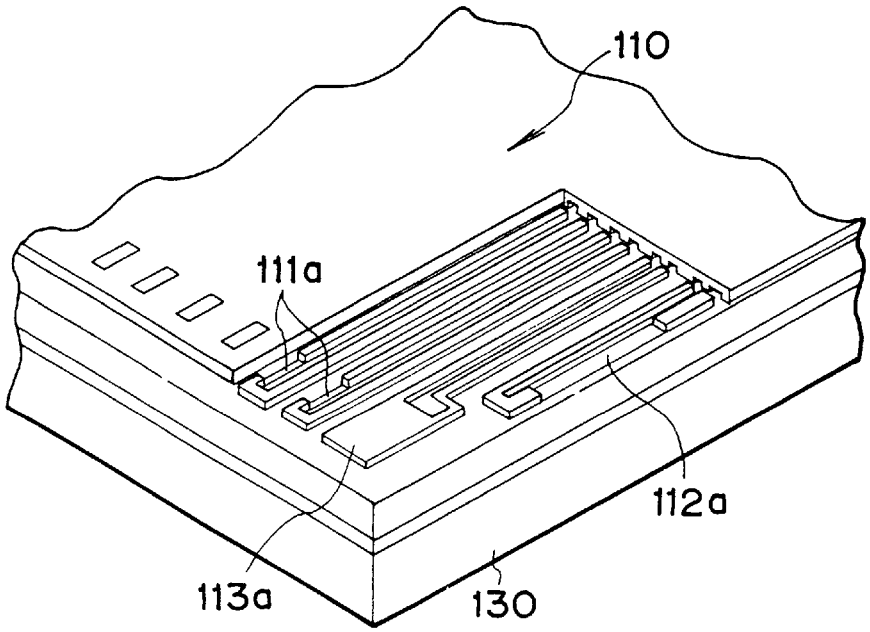

As a development of the present embodiment, it may be possible to apply this embodiment to a recording apparatus which is able to control its discharging amount in order to implement the stabilized discharging against the discharging amount of the recording head which tends to vary due to the ambient temperatures and the temperature of the recording head itself. In this case, it will suffice if only the table of the amounts of exhausted ink per ambient temperature as shown in FIGS. 12A and 12B are formed in accordance with the amounts of exhausted ink corresponding to the ambient temperatures and the temperatures of recording head when the amount of discharged ink is controlled. Moreover, it may be possible to measure the amount of stored ink on the assumption that the amount of exhausted ink is constant when the amount of exhausted ink is sufficiently stable irrespective of the aforesaid temperatures because of the controlled amount of each discharge.

(Sixth Embodiment)

In the fifth embodiment, although the measurement of the amount of stored ink is made by detecting the ambient temperatures for the correction of the above-mentioned amount of exhausted ink, a structure may be considered to provide the means which is capable of detecting the temperatures of the above-mentioned recording head unit, and to make such a correction on the basis of the detected result of the aforesaid temperatures.

FIGS. 12A and 12B are views showing a structural example of a temperature sensor for detecting the heater board temperatures of ink discharging heaters of a recording head as an example of detecting means to detect the temperatures of the recording head unit.

FIGS. 12A and 12B are the detailed view of the heater board 110 of an ink jet recording head, in which a reference number 111 designates the array of discharge heaters arranged corresponding to each of the nozzles provided continuously for ink discharging ports. By applying a voltage to this discharge heater array 111, ink in the nozzles receives thermal energy to make the ink liquid droplets to be discharged from the ink discharging ports for recording. Reference numerals 112*a* and 112*b* designate the heaters to give heat to the vicinity of the heater board 110; 113*a* and 113*b*, the temperature sensors which can be fabricated by the semiconductor film formation technique used for the fabrication of the discharge heater array 111, and the heaters 112*a* and 112*b* which provide heat, at the same time that these elements are prepared. The sensors detect the temperatures in the vicinity of the discharge heater array 111. Also, the section indicated by slanted lines represents the connecting positions for the ceiling board and the base plate 130 where the discharge heater array 111, the electrodes, the heaters 112*a* and 112*b* which provide heat, and others are formed. The temperature sensors 113*a* and 113*b* are diode sensors, for example, and the output value is arranged to vary approximately 2.5 mV per degree of temperature.

When such sensors are used, too, it is possible to arrange a table representing the corrected amount of exhausted ink corresponding to the detected temperatures by the temperature sensors in the same manner as providing the one shown in FIGS. 12A and 12B in the fifth embodiment, and further, to apply a control in the same manner as in the example of control shown in FIG. 11.

Also, in the present embodiment, while the heater board temperatures of the discharge heaters of the recording head are detected, it is conceivable that the application can be arranged by providing the temperature sensors for the ink supply member to supply ink to the recording head.

(Seventh Embodiment)

Now, the description will be made of another embodiment in which the present invention is further applicable to the foregoing second and third embodiments. In the second embodiment, the detection of the recording head replacement is made by detecting a period of time during which the recording head is absent as described earlier.

However, it is conceivable that the detection of the recording head replacement is conducted by the operator who instructs a recording head replacement through the input meas 1005 and 1006. This is practicable by arranging a structure which enables ink exhaust means to operate in a state that the ink exhaust from the recording head is disabled when the recording head replacement is instructed through the input means 1005 and 1006.

In the third embodiment, too, a similar development is conceivable. It may be possible to recognize different recording heads by an instruction from the operator through the input means 1005 and 1006 without using the structure of the recording head for the purpose to recognize such heads.

(Eighth Embodiment)

Figure 13:
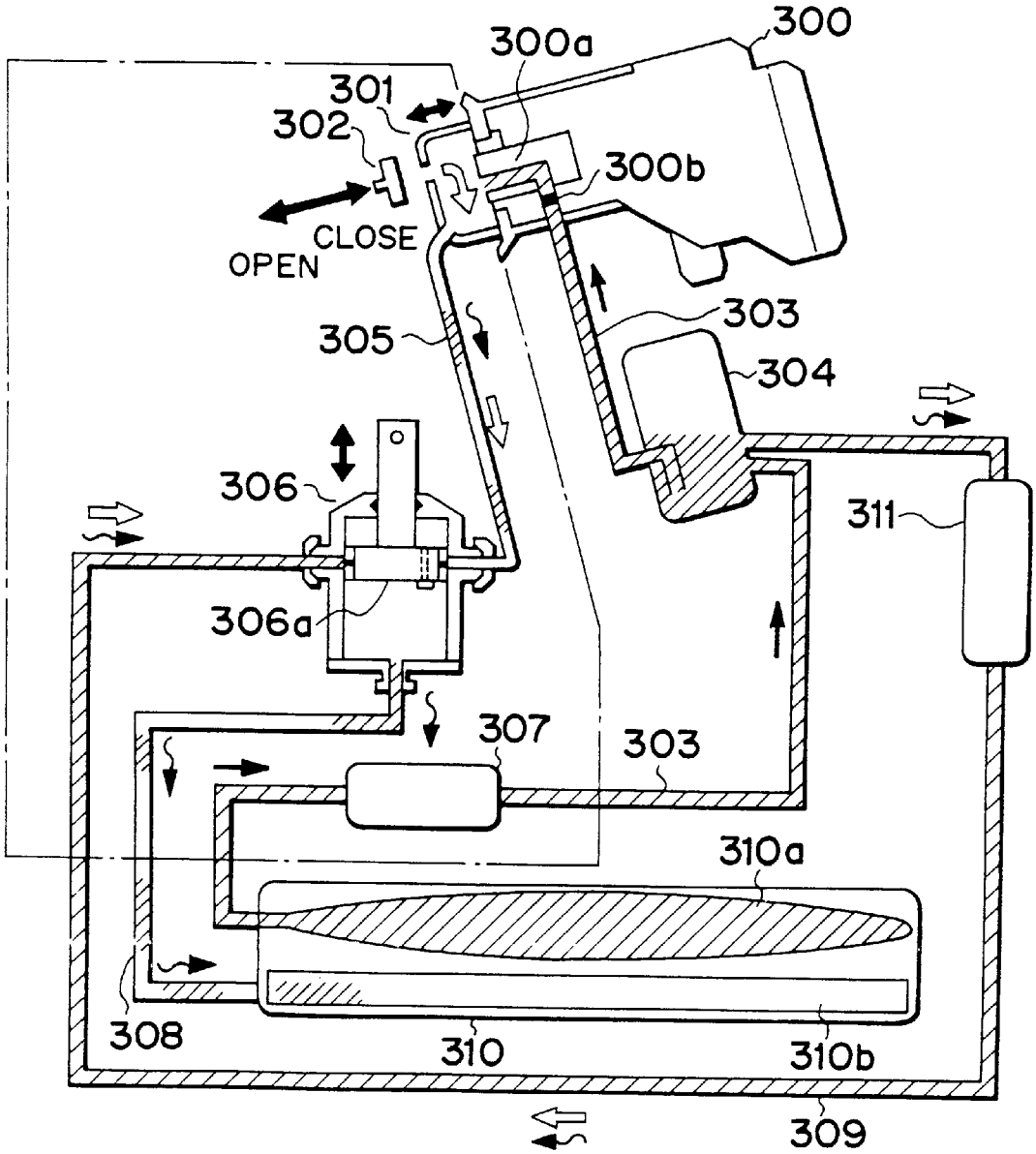
FIG. 13 is a view illustrating an ink jet recording apparatus provided with a sub tank which is a second ink tank according to a eighth embodiment.

In the embodiments according to the present invention, which have been described so far, the ink which flows into the ink retaining member is the ink exhausted from the ink discharging ports of the recording head. However, the description will be made of an embodiment in which the present invention is applicable when ink is also exhausted from an ink supply member in a recording apparatus wherein a recording head and an ink supply member to supply ink to the recording head are provided to constitute recording means. FIG. 13 shows a recording apparatus which is provided with an ink pack 310*a*, a first ink tank serving as an ink supply member, and a sub-tank 304, a second ink tank. In FIG. 13, a reference numeral 300 designates a recording head having an ink filter 300*b* and discharging ports (nozzles) 300*a*; 301, a cap which is used for the execution of the above-mentioned discharge recovery process, and the protection of the recording heads; 302, an air valve which can be opened and closed in order not to press the air in the cap to flow into the discharging ports when capping the recording head with the cap 301. The recording head is connected to an ink supply tube 303 through the sub-tank 304 whose liquid level is maintained constantly to keep the meniscuses of the discharging ports in a stabilized condition. The sub-tank 304 is connected to the ink pack 310*a* of the ink tank 310 through an ink remain sensor 307 and the ink supply tube 303 for ink supply. The cap 301 is connected to a suction pump 306 by a suction tube 305.

When the suction pump 306 generates a suction force by the execution of a discharge recovery process, ink is conducted to an exhaust ink absorbent 310*b* through a passage such as indicated by an arrow B in FIG. 13. To the exhaust ink absorbent 310*b*, ink from the discharging ports (nozzles) 300*a* of the recording head 300 and ink from the above-mentioned sub-tank 304 are conducted. The sub-tank and exhaust ink absorbent are connected by a sub-tank suction tube 309 through an exhaust ink sensor 311. From the sub-tank 304, the air is also sucked simultaneously as indicated by an arrow C in FIG. 13 so that a depressurized state is created abruptly in order to supply ink from the ink pack 310*a* rapidly. The ink supply path is represented by an arrow A.

As a result, with a structure arranged such as this, the ink from the sub-tank which is the second tank is exhausted to the exhaust ink absorbent 310*b* which serves as an ink retaining member in addition to the ink from the recording head.

To measure the amount of stored ink in a recording apparatus having the above-mentioned structure, the amount of exhausted ink C2 from the sub-tank which is detected by the exhaust ink sensor 311 as an ink amount exhausted by the forcible suction for the discharge recovery process should be added to the amount of exhausted ink Cl from the recording head by the following operational expression, and accumulated to the total execution number N1 of the forcible suctions, and also, the amount of exhausted ink from the recording head should be taken into account. The above-mentioned exhaust ink sensor is a pressure sensor, weight sensor, or the like, and only when the ink exhaust from the sub-tank is recognized, its measurement is made:

$$(C1+C2)\times N1+C3\times N2 \quad (5)$$

where the C3 stands for the amount of exhausted ink per preliminary discharge, and the N2, the total execution number of preliminary discharges.

In this way, even in an recording apparatus which is provided with a second ink tank such as a sub-tank, it is possible to measure the amount of stored ink in the exhaust ink tank retaining the exhausted ink by obtaining such an amount after a correction given in consideration of the amount of exhausted ink from the aforesaid ink tank.

Also, in a recording apparatus having such a structure as this, when a recording head and an ink tank are arranged as separate elements which are individually replaceable, and recording heads having different characteristic properties, recording heads for color use, or some others are installed, it is possible to measure the amount of stored ink exactly by combining the present embodiment with the foregoing first, second, third, and fourth embodiments according to the present invention. Further, the present embodiment is applicable by combining it with the detection method in which the correction is made for each amount of exhausted ink in accordance with the ambient temperatures and the method for measuring the amount of stored ink on the basis of an instruction from the operator, which are described in the fifth and sixth embodiments.

(Ninth Embodiment)

In each of the above-mentioned embodiments, the description has been made of the structures with which to prevent any leakage of exhausted ink from the exhaust ink retaining member by measuring the amount of stored ink in the exhaust ink retaining member. Here, the description will be made of an embodiment in which the present invention is applicable when the exhaust ink should leak from the exhaust ink retaining member due to some malfunction which may take place in the measurement mechanism.

In a case of the ink jet recording apparatus shown in FIG. 1, an ink detection unit which will be described later is arranged at the bottom of the apparatus within the traveling range of the carriage 202 on which the ink jet recording head and ink tank are mounted. also, in a case of the ink jet recording apparatus shown in FIG. 13, an ink detection unit which will be described later is arranged likewise under the ink tank 310. The details of this ink detection unit will be described using an ink jet recording apparatus shown in FIG. 14.

Figure 14:
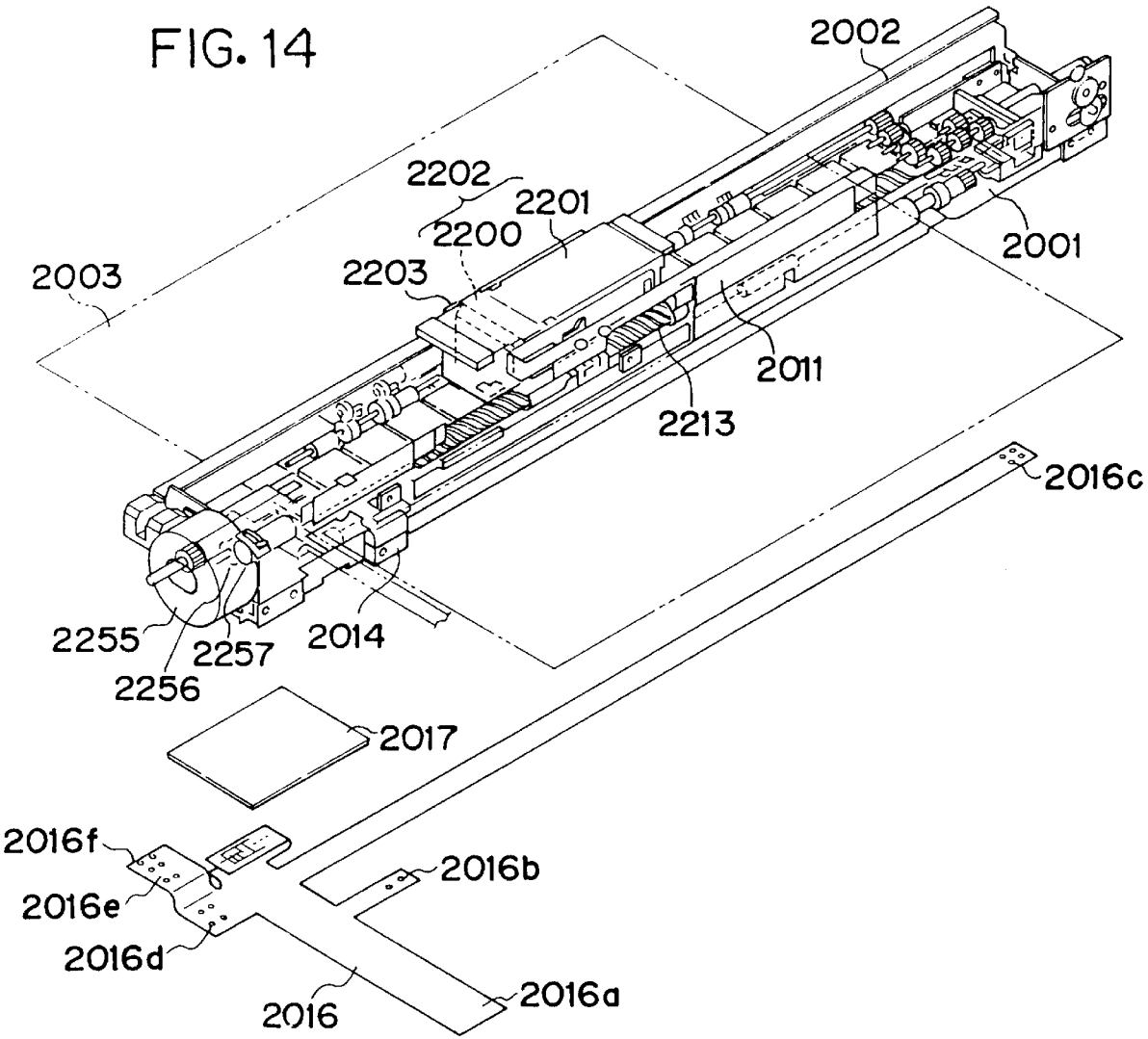
FIG. 14 is a perspective view showing entirely an ink leakage detection unit according to a ninth embodiment.

In FIG. 14, a head cartridge with which the recording head 2200 and ink tank 2201, constituting a recording unit, are coupled is mounted on a carrier 2203. In this respect, the recording head 2200 and ink tank 2201 are individually attachable to and detachable from the carrier, respectively. One end of the carrier 2203 on the recording head 2200 side is coupled to the lead screw 2213 which is rotatively fixed to a chassis 2001 so that the carrier is fitted slidably in the axial direction. On the other end of the carrier 2203, a guide is arranged. The guide is slidably fitted into the guide rail 2002 which is formed on the chassis 2001 in parallel to the axial direction of the lead screw 2213. The carrier 2203 is arranged to reciprocate in the axial direction along the rotation of the lead screw 2213 while keeping its posture constantly at all times.

In other words, the lead screw gear 2257 fixed to the left-side end of the lead screw 2213 and a pinion gear 2256 fixed to the output shaft of a carrier motor 2255 engage with each other, and a lead pin fixed to the carrier 2203 is inserted into the guide groove formed spirally on the lead screw 2213 at a given pitch. Therefore, along the regular and reverse drives of the carrier motor 2255, the lead screw rotates, thus allowing the carrier to reciprocate. On the carrier 2203, an electrical connector is provided in a portion where the carrier abuts on the recording head 2200. From the electrical connector, a flexible cable is electrically connected to the recording head 2200 to transmit the recording signals to it from the electric circuit provided for the apparatus. This flexible cable is positioned and held by a flexible cable holder 2160 in a pinch roller frame 2011.

The recording head 2200 is driven in synchronism with the reciprocation of the carrier 2203 to discharge ink in accordance with recording signals for one-line recording on a recording medium. The recording head 2200 is provided with fine liquid discharging ports (orifices), liquid passages, and energy actuation parts arranged in parts of the liquid passages, and the energy generating parts which generate droplets formation energy to activate the liquid in the actuation parts.

Further, in conjunction with FIG. 14, the description will be made of an ink leakage detection unit according to the present embodiment.

In FIG. 14, a reference numeral designates a collective flexible cable which is arranged on the bottom face of the ink jet recording apparatus. On the collective flexible cable 2016, a connector 2016*a* to connect the cable to the controller (not shown) of the ink jet recording apparatus, a paper sensor section 2016*b* soldered to a paper sensor 2014, a feed motor section 2016*c* soldered to a feed motor 2005, a carrier motor section 2016*d* soldered to a carrier motor 2225, an HP sensor section 2016*e* soldered to an HP sensor, and a thermistor section 2016*f* soldered to a thermistor.

Figure 15:
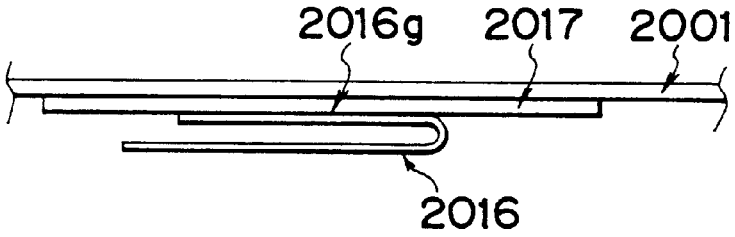
FIG. 15 is a cross-sectional view showing the ink leakage detection unit according to the ninth embodiment.

A reference numeral 2016*g* designates the ink detection unit, which is bent at an angle of 180° to the collective flexible cable 2016 as shown in FIG. 14 and FIG. 15, and is arranged to allow the pattern surface to appear at the upper face. The ink detection unit 2016*g* is positioned at the lower face of the chassis 2001 through an ink absorbent board 2017.

Figure 16:
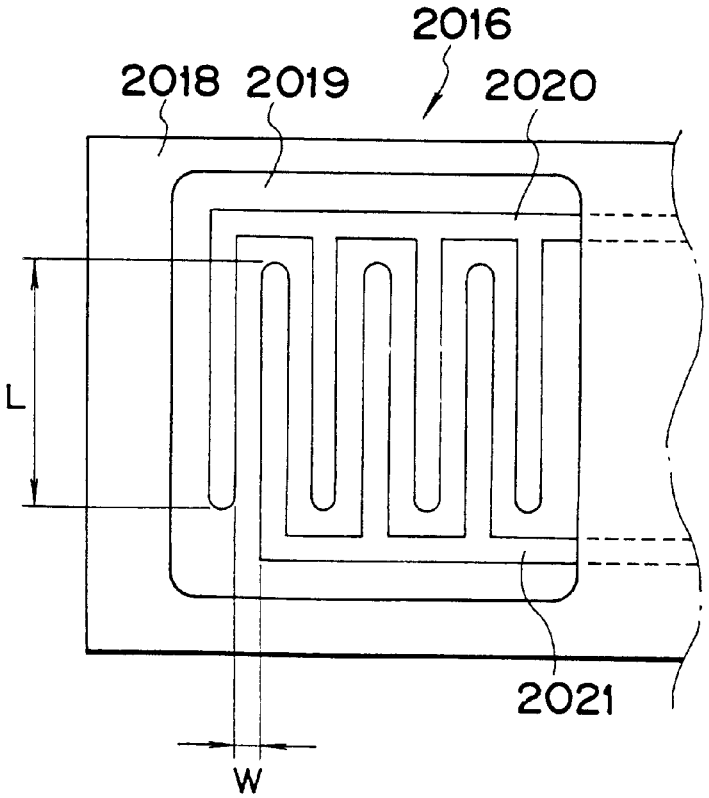
FIG. 16 is an enlarged plan view showing the ink leakage unit according to the ninth embodiment.

FIG. 16 is a view showing the ink detection unit 2016*g* in detail. A first pattern 2020 and a second pattern 2021 are combined in a comb tooth fashion. A reference numeral 2018 designates a cover layer section for the flexible cable; 2019, no cover layer section where the cover layer is removed. The first pattern 2020 and second pattern 2021 are exposed in this no cover layer section. A reference mark W designates a pattern interval which is approximately 1 mm in the present embodiment; and L, the length of overlap of the patterns, which is defined to be approximately 10 mm in the present embodiment.

Now, the detailed description will be made of the function of the ink leakage detection unit structured as above.

Figure 19:
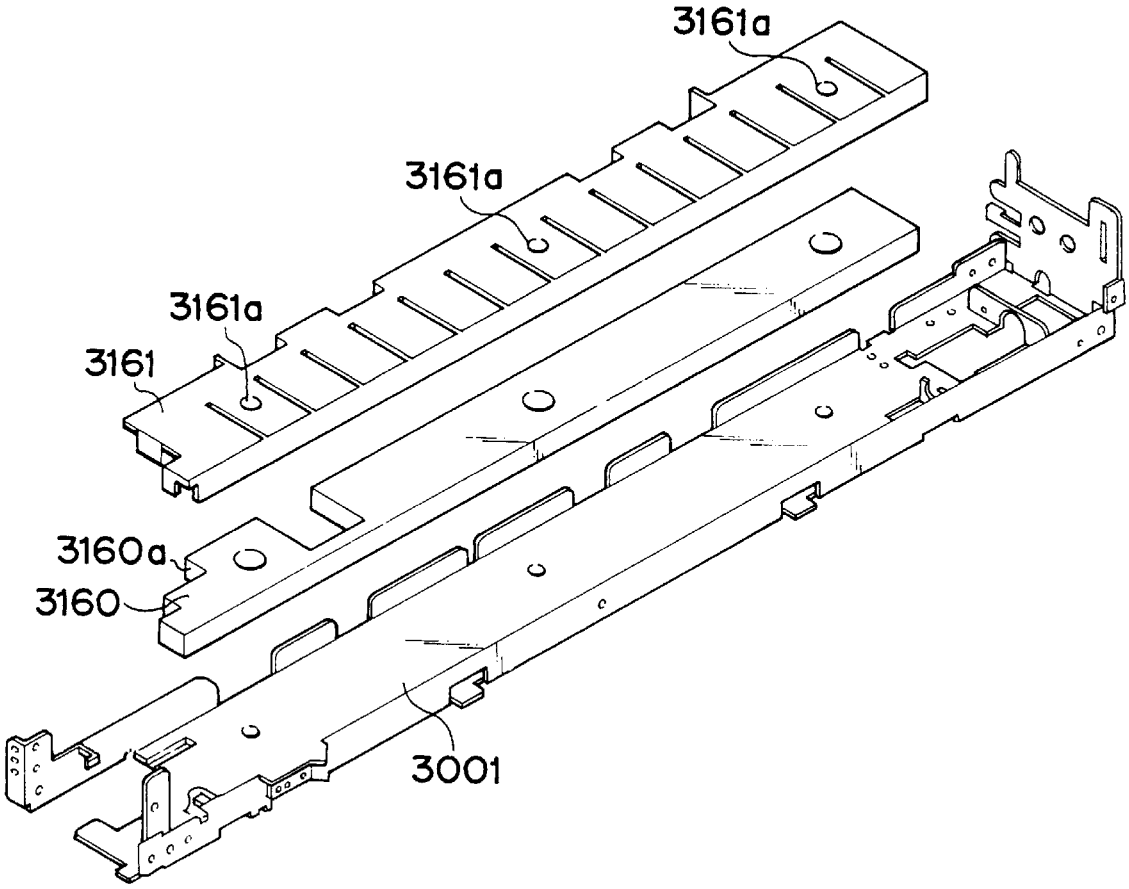
FIG. 19 is an exploded perspective view showing the tank unit for exhaust ink according to a twelfth embodiment.

In the chassis 2001, an exhaust ink tank 2161 which serves as an exhaust ink retaining member is arranged in a platen 2022 across almost the entire length of the chassis 2001 as shown in FIG. 19. Then, if the exhaust ink leaks from the exhaust ink tank or the ink leaks due to an abnormal condition occurring in the recovery mechanism, ink supply passages, recording head, or the like, the ink which leaks flows along the inner face of the chassis 2001 and drops down to the lower face of the chassis 2001 from the cut off portion (not shown) provided for the chassis 2001 in the vicinity of the recovery mechanism.

The aforesaid ink is absorbed and held by the ink absorbent board 2017 shown in FIG. 14 and FIG. 15. Since the ink detection unit 2016*g* abuts on the ink absorbent board 2017, the surface of the ink detection unit 2016*g* is wet by the aforesaid ink.

Here, the ink generally used contains water of approximately 80%, and the remainder is composed of an organic solvent and dye. Therefore, the ink has electric conductivity. More specifically, ink is absorbed by a blotting paper for office use, and then, the value of its resistance is measured. The value is approximately 200 KΩ in condition that a pair of electrode of 10 mm long are arranged at intervals of 1 mm. In the structure of electrodes shown in FIG. 16, six pairs of electrodes of 10 mm are arranged at intervals of 1 mm. Therefore, the resistance value between the first pattern 2020 and second pattern 2021 is 200/6=33.3 KΩ in a state that the ink is permeated into the ink absorbent board 2017.

When the ink absorbent board 2017 is dry, the above-mentioned resistance value is almost infinite. Thus it is possible to detect the abnormal ink leakage as far as the controller of an ink jet recording apparatus measures the resistance value between the first pattern 2020 and second pattern 2021, and to minimize damages to the recording apparatus by informing the operator of such abnormality or suspending the recording operation among other means in accordance with the detection of the ink leakage.

(Tenth Embodiment)

Figure 17:
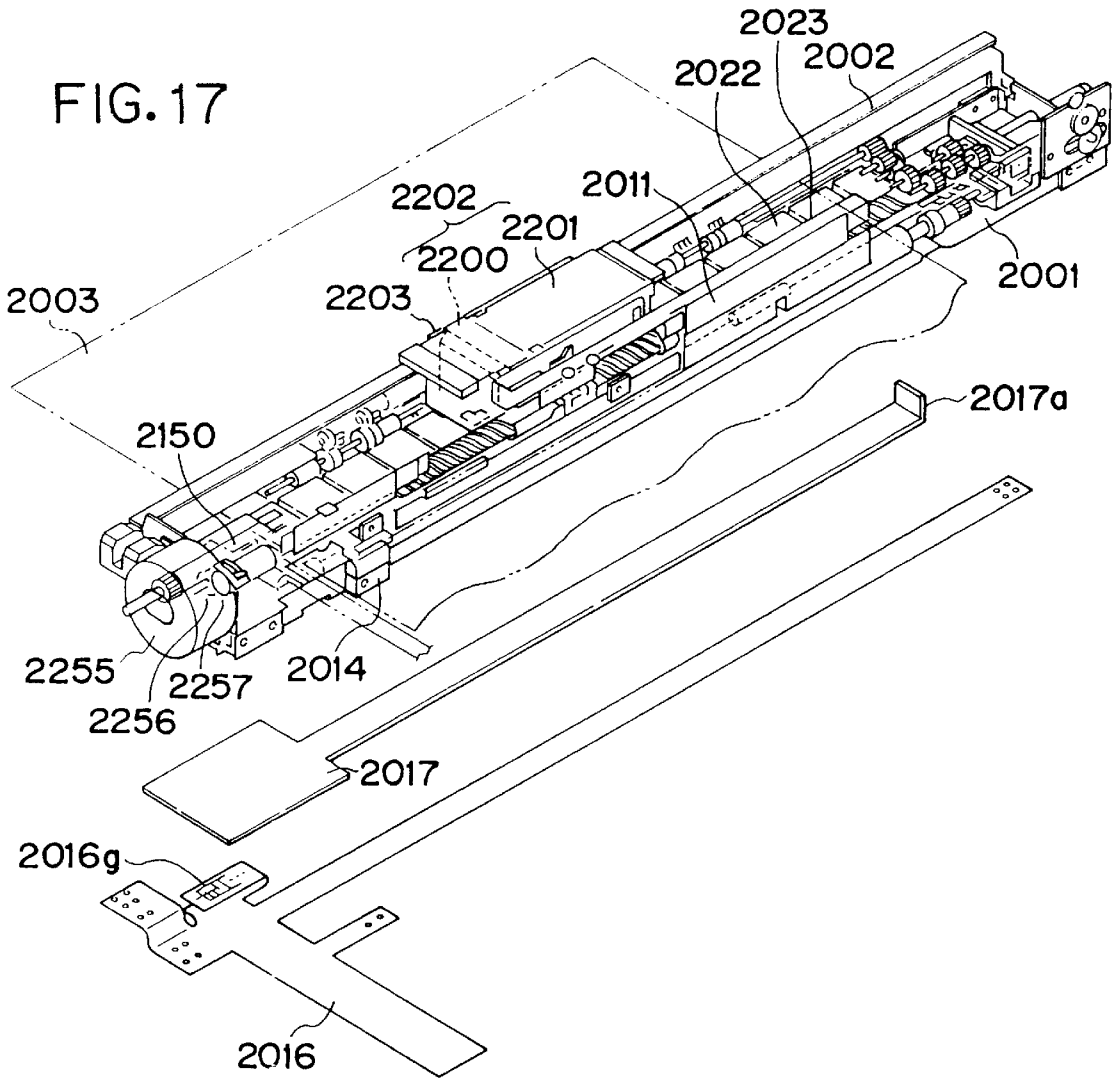
FIG. 17 is a perspective view showing a tenth embodiment entirely.

FIG. 17 is a view showing another embodiment according to the present invention, which corresponds to FIG. 14 for the ninth embodiment. In FIG. 17, a reference numeral 2022 designates a platen which is arranged across almost the entire length of the chassis 2001. Further, in the platen 2022, an exhaust ink absorbent is housed to receive the exhausted ink from a pump unit 2150.

The exhausted ink from the pump unit 2150 is absorbed into the exhaust ink absorbent 2023 from the left-hand side in FIG. 17. The structure is arranged so that as the amount of exhausted ink increases, the exhausted ink shifts in the exhaust ink absorbent 2023 in the direction toward the right-hand side in FIG. 17.

The ink absorbent board 2017 extended in the direction to the right-hand side as compared to that in the ninth embodiment, and its leading end 2017*a* is bent upward to penetrate the chassis 2001 and abuts on the right-side end of the aforesaid exhaust ink absorbent.

According to the present embodiment, as the exhausted ink from the pump unit 2150 increases, the exhausted ink shifts in the direction to the right-hand side. When the exhausted ink reaches the right-side end of the exhaust ink absorbent 2023 at last, the exhausted ink is absorbed from the leading end of the ink absorbent board 2017, and ultimately, absorbed into the entire part of the ink absorbent board 2017.

As a result, by means of the ink detection unit 2016*g* of the collective flexible cable 2016, it is possible to detect such a state as this, that is, the exhausted ink is filled in the exhaust ink absorbent completely or the ink leakage occurs.

With the structure as arranged in the present embodiment, it is possible to effectively increase the flexibility with which to connect the ink detection unit 2016*g* with a plurality of locations, not necessarily in tow places, to carry out the ink detection as desired depending on the configuration of the ink absorbent board 2017 irrespective of the current arrangement of the ink detection unit 2016*g*.

(Eleventh Embodiment)

Figure 18:
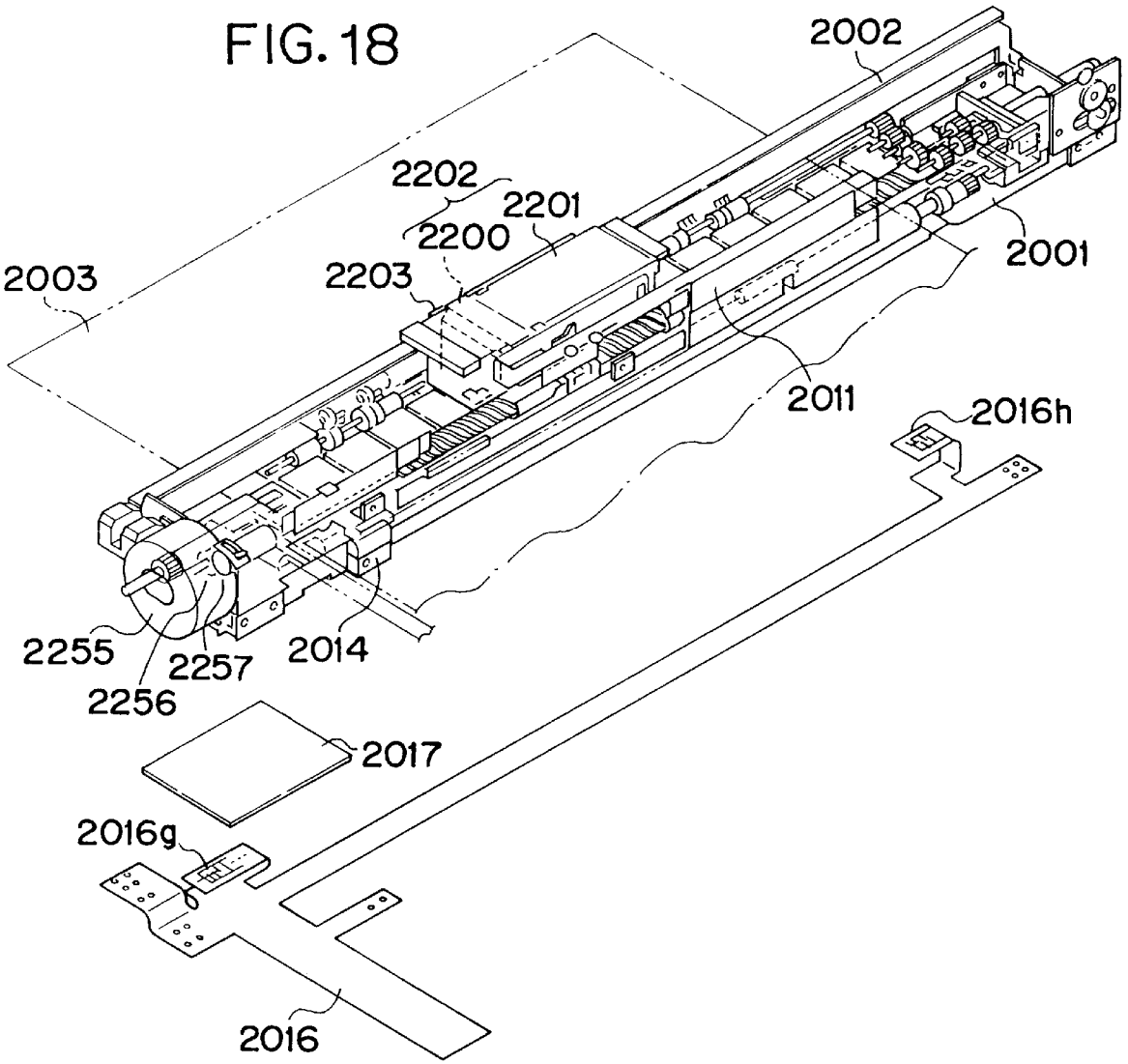
FIG. 18 is a perspective view showing a eleventh embodiment entirely.

FIG. 18 is a view showing another embodiment, which is equivalent to FIG. 14 for the ninth embodiment. In FIG. 18, a reference numeral 2016*h* designates a second detection unit provided for a collective flexible cable 2016. The structure is the same as the ink detection unit 2016*g*. The second ink detection unit 3016*h* is bent upward to penetrate the chassis 2001 to abut on the right-side end of the exhaust ink absorbent 2023.

If the ink detection unit 2016*g* and the second ink detection unit 2016*h* are arranged to be independent circuit structures, respectively, it is possible to detect the ink leakage and the life of the exhaust ink absorbent independently. If these two units are arranged in parallel, the detections can be dispensed with only one detection circuit, although either one of the two events can no longer be detected. Yet, the structure can be arranged at a low cost.

In the present embodiment, the ink detection unit is arranged in two places, but it may be possible to arrange the unit in the places more than two.

(Twelfth Embodiment)

In the above-mentioned embodiments, although the ink detection unit is formed by an individual circuit, it may be possible to arrange the structure so that the detection unit is connected to some electrical circuit arranged for the collective flexible cable 2016.

For example, in the thermistor unit 2016*f*, a thermistor is provided for measuring the ambient temperature of the printer unit. Now, the description will be made of a case where the ink detection unit is arranged in parallel with such a thermistor.

The characteristic properties of the thermistors available from the market are various. Some of them has characteristics of 600 KΩ at 0° C., and 70 KΩ at 40° C. In the present embodiment, the ink detection unit indicates 33.3 KΩ when ink leaks. The apparent resistance value of the thermistor 29 KΩ at 0° C. and 21 KΩ at 40° C. Thus, to compared to the state where the temperature is normally measured, the detected value is obviously small. As a result, it is possible for the controller to detect an ink leakage by referring to the resistance value of the thermistor.

With this structure, it is possible to share the use of the detection circuits for the thermistor and the ink leakage, and, therefore, realize the manufacture of an ink jet recording apparatus at a low cost.

(Thirteenth Embodiment)

In the above-mentioned embodiments, the description has been made of the structure arranged by a flexible cable, but it is not necessarily limited to such an arrangement. The arrangement may be possible by use of the usual printed-circuit board which has a high rigidity.

It will suffice if only the structure is arranged so that ink is reliably in contact with the ink detection unit 2016*g*. Then there is no need for the presence of the ink absorbent board 2017. The arrangement can be made at a lower cost.

Further, in the present embodiment, although the ink detection unit 2016*g* is arranged on the lower face of the carrier, the position of the ink detection unit 2016*g* and the direction in which it should be arranged are not confined if only means to conduct ink to the ink detection unit 2016*g* can be arranged.

Furthermore, in the present embodiment, although the description has been made of the use of the collective flexible cable 2016, it is of course possible to effectuate this embodiment by the use of the flexible cable which transmits recording signals from the aforesaid electric circuit on the apparatus side to the recording head.

As described above, according to the ninth to thirteenth embodiments, an exposed pattern is provided on the printed-circuit board which connects each of the structural elements electrically in order to detect the ink leakage due to any abnormal operation. Hence, there is no increase in the number of parts, and a highly reliable ink jet recording apparatus can be provided at a low cost.

Also, by combining the exhaust ink measuring methods described in the first to eighth embodiments with the ninth to thirteenth embodiments, respectively, it is possible to inform the operator reliably of the event that the exhaust ink is fully stored in the exhaust ink retaining member or the amount of stored ink arrives at a given storage.

(Fourteenth Embodiment)

Now, the description will be made of an embodiment according to the present invention, which makes it possible to use of the exhaust ink absorbent continuously after the exhausted ink in the exhaust ink retaining member reaches a regulated storage or as required by the operator.

Figure 20:
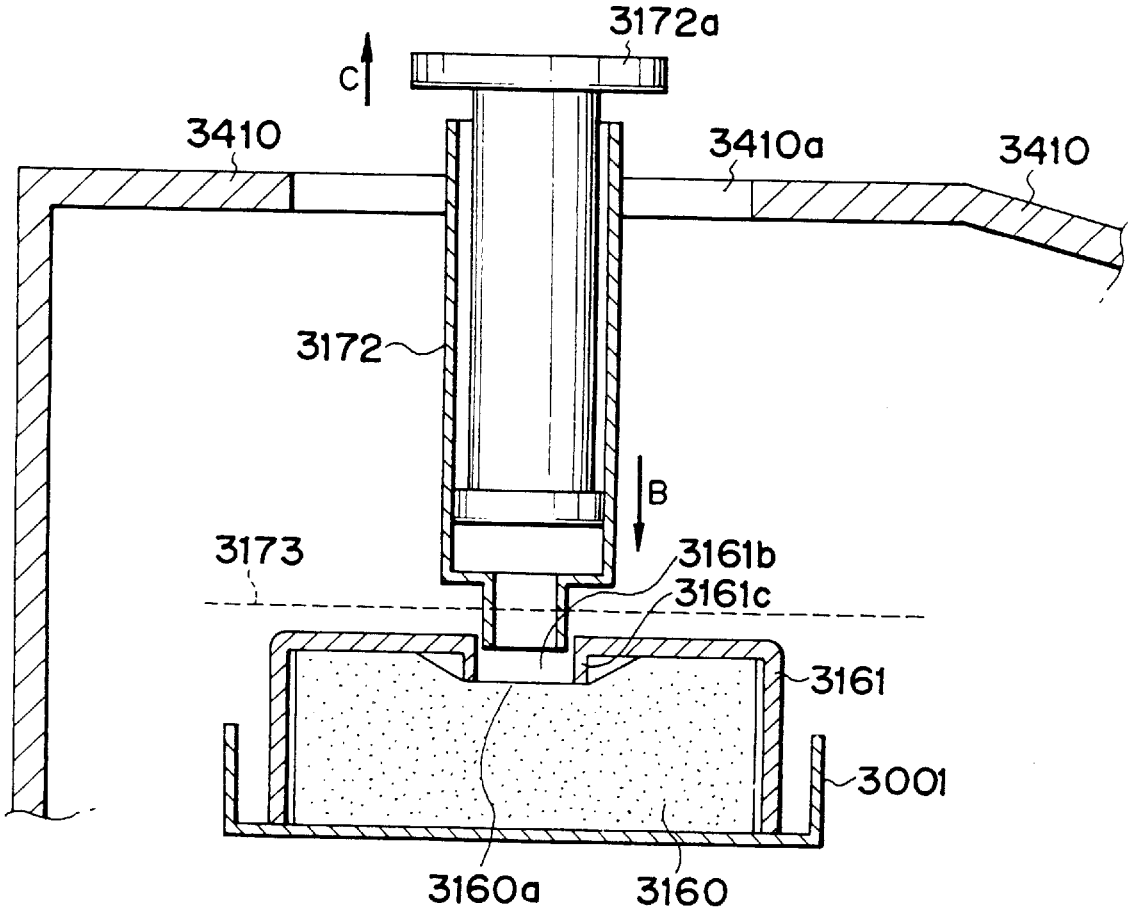
FIG. 20 is a cross-sectional view showing the state that a pump is being used for the reuse of an exhaust ink absorbent.

Here, FIG. 19 is a partially perspective view illustrating the exhaust ink tank unit, which represents the characteristics of the present embodiment. In FIG. 19, a absorbent 3160 is covered with a platen 3161 which serves as a covering member. The platen 3161 is coupled to a chassis 3001 shown in FIG. 14 by means of screws and other through a plurality of recesses 3161*a*. Also, the platen 3161 has a plurality of holes 3161*b* and is conductively connected to the absorbent 3160. FIG. 20 is a cross-sectional view taken along the line A—A in FIG. 19 to illustrate the platen as a product, and the state of use of the pump 3172 for reuse of the absorbent 3160. A reference numeral 3410 designates the exterior material of the recording apparatus, and 3410*a*, an aperture arranged for the external material. Usually this aperture 3410*a* is used for replacing heads or ink tanks, and its position agrees with that of the holes 3161*b* of the platen 3161.

Also, the rib 3161*c* of the hole 3161*b* of the platen 3161 presses the absorbent 3160 to form a recess 3160*a*. As a result, only the portion of the hole 3161*b* which is conductively connected to the absorbent 3160 is away from the feeding plane 3173 of the recording sheet. Thus there is no possibility that the recording sheet is stained by the exhausted ink permeated into the absorbent 3160. Also, there is no need for the capacity of the absorbent 3160 is reduced significantly. Nevertheless, if only the aforesaid recess 3161*a* is an aperture provided for the platen 3161, the desired effects given below may be obtainable.

The operator, having been informed of the amount of exhausted ink approaching the full capacity of the absorbent 3160, inserts the pump 3172 for reuse of the absorbent through the aperture 3410*a* provided for the external material 3410 of the recording apparatus, and further, inserts the leading end of the pump 3173 into the hole 3161*b* of the platen 3161 in the direction indicated by an arrow B. Then, by shifting the piston 3172*a* in the direction indicated by an arrow C, the exhausted ink permeated into the absorbent 3160 is sucked to the pump 3172 for reuse of the absorbent. In this way, the absorbent 3160 becomes reusable. In this respect, when the absorbent 3160 is reused, the measurement unit for exhausted ink should be reset.

As described above, according to the present embodiment, the structure is arranged to provide a hole which is conductively connected to the absorbent on the cover member of the exhaust ink absorbent of the exhaust ink tank. Therefore, the operator carries out a suction of the exhausted ink retained in the absorbent through this hole by use of a pump provided as an attachment, hence making it possible to reuse the absorbent. Also, it becomes unnecessary for the operator to execute the replacement of the exhaust ink tanks.

As described above, if each of the first to eighth embodiments and each of the ninth to thirteenth embodiments are combined with the fourteenth embodiment for execution, it is possible for an ink jet recording apparatus to measure more accurately the amount of exhausted ink to be stored in the exhaust ink retaining member. Should there be any errors in measurement, it is possible to minimize the occurrence of damage to the apparatus by detecting the ink leakage to the interior of the apparatus. Also, by removing the exhausted ink in the exhaust ink retaining member, it becomes possible to reuse the exhaust ink retaining member.

(others)

In this respect, the present invention is applicable to an ink jet recording apparatus which uses electromechanical transducers such as piezoelectric elements and others as recording means (recording head), but the present invention produces an excellent effect particularly on an ink jet recording apparatus of a type which used an method to discharge ink by the utilization of thermal energy. By the application of such a method as this, it is possible to achieve a higher density of recording in a higher precision.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system as well. Particularly, however, it is suitable for the on-demand type because the principle is such that at least one driving signal, which provides a rapid temperature rise beyond a departure from nucleation boiling point in response to recording information, is applicable to an electrothermal transducer disposed on a liquid (ink) retaining sheet or liquid passage whereby to cause the electrothermal transducer to generate thermal energy to produce film boiling on the thermoactive portion of the recording head; thus effectively leading to the resultant formation of a bubble in the recording liquid (ink) one to one for each of the driving signals.

By the development and contraction of the bubble, the liquid (ink) is discharged through a discharging port to produce at least one droplet. The driving signal is more preferably in the form of pulses because the development and contraction of the bubble can be effectuated instantaneously, and, therefore, the liquid (ink) is discharged with quick response. The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid passages, and the electrothermal transducers as disclosed in the above-mentioned patents (linear type liquid passage or right angle liquid passage). Besides, the structure such as disclosed in the specifications of U.S. Pat. Nos. 4,558,333 and 4,459,600 wherein the thermal activation portions are arranged in a curved area is also included in the present invention. In addition, the present invention is effectively applicable to the structure disclosed in Japanese Patent Laid-Open Application No. 59-123670 wherein a common slit is used as the discharging ports for plural electrothermal transducers, and to the structure disclosed in Japanese Patent Laid-Open Application No. 59-138461 wherein an aperture for absorbing pressure wave of the thermal energy is formed corresponding to the discharging ports. In other words, according to the present invention, the recording is executed reliably and efficiently irrespective of the various modes of the recording head.

Furthermore, the present invention is effectively applicable to the recording head of a full-line type having a length corresponding to the maximum width of a recording material (recording medium), which is recordable by a recording apparatus. The full-line head may be the one which is structured by combining a plurality of the recording heads or a single full-line recording head which is integrally formed. Either will do. In addition, the present invention is effectively applicable to a serial type recording head as exemplified above; to a replaceable chip type recording head which is electrically connected to the main apparatus and for which the ink is supplied when it is mounted in the main assemble; or to a cartridge type recording head having an ink tank integrally provided for the head itself.

Also, it is preferable to additionally provide the recording head recovery means and preliminarily auxiliary means as constituents of the recording apparatus according to the present invention because these additional means will contribute to enabling the effectiveness of the present invention to be more stabilized. To name them specifically, such constituents are capping means for the recording head, cleaning means, compression or suction means, preliminary heating means such as electrothermal transducers or heating elements other than such transducers or the combination of those types of elements. It is also contributable to executing a stabilized recording that the preliminary discharge mode is adopted aside from the regular discharging for recording.

Further, regarding the kinds or the number of the recording heads to be mounted, it may be possible to provide two or more heads corresponding to a plurality of ink having different recording colors or densities. In other words, the present invention is extremely effective in applying it not only to a recording mode in which only main color such as black or the like is used, but also to an apparatus having at least one multi-color mode with ink of different colors, or a full-color mode using the mixture of the colors, irrespective of whether the recording heads are integrally structured or it is structured by a combination of plural recording heads.

Furthermore, in the embodiments according to the present invention set forth above, while the ink has been described as liquid, it may be an ink material which is solidified below the room temperature but liquefied at the room temperature. Since the ink is controlled within the temperature not lower than 30° C. and not higher than 70° C. to stabilize its viscosity for the provision of the stable discharge in general, the ink may be such as to be liquefied when the applicable recording signals are given. In addition, while positively preventing the temperature rise due to the thermal energy by the use of such energy as an energy utilized for changing states of ink from solid to liquid, or using the ink which will be solidified when left intact for the purpose of preventing the ink from being evaporated, it may be possible to adopt for the present invention the use of an ink having a nature of being liquefied only by the application of thermal energy, such as an ink capable of being discharged as ink liquid by enabling itself to be liquefied anyway when the thermal energy is given in accordance with recording signals, and an ink which will have already begun solidifying itself by the time it reaches a recording medium.

In such a case, it may be possible to retain the ink in the form of liquid or solid in the recesses or through holes of a porous sheet such as disclosed in Japanese Patent Laid-Open application No. 54-56847 or 60-71260 in order to enable the ink to face the electrothermal transducers. In the present invention, the most effective method for the various kinds of ink mentioned above is the one capable of implementing the film boiling method as described above.

Further, as the mode of the recording apparatus according to the present invention, it may be possible to adopt a copying apparatus combined with a reader in addition to the image output terminal which is integrally or independently provided for a word processor, computer, or other information processing apparatus, and furthermore, it may be possible to adopt a mode of a facsimile apparatus having transmission and reception functions.

What is claimed is:

1. An ink jet recording apparatus having a waste ink container for monitoring an ink level, and for determining a waste ink amount of said recording apparatus on which a plurality of kinds of ink jet heads each having different properties regarding an ink exhaust amount are separately mounted, said apparatus comprising:

a mounting portion for mounting a plurality of kinds of ink jet heads in a state that the heads are capable of discharging ink;

detecting means for detecting ink exhaust properties of an ink jet head mounted on said mounting portion; and correcting means for correcting the waste ink amount exhausted from the mounted ink jet head in accordance with the detected properties of said mounted ink jet head.

2. An apparatus according to claim 1, wherein the mounted ink jet head has an electrothermal converting element and discharges ink by using thermal energy generated by said electrothermal converting element.

3. An ink jet recording apparatus having a waste ink container for monitoring an ink level, and for determining a waste ink amount of said recording apparatus on which a plurality of kinds of ink jet heads each having different properties regarding an ink exhaust amount are separately mounted, said apparatus comprising:

a platen for supporting a recording medium opposed to said ink jet heads;

a mounting portion for mounting a plurality of kinds of ink jet heads in a state that the heads are capable of discharging ink;

detecting means for detecting ink exhaust properties of an ink jet head mounted on said mounting portion; and correcting means for correcting the waste ink amount exhausted from the mounted ink jet head in accordance with the detected properties of said mounted ink jet head.

4. An apparatus according to claim 3, wherein the mounted ink jet head has an electrothermal converting element and discharges ink by using thermal energy generated by said electrothermal converting element.

5. An apparatus according to claim 3, wherein said correcting means corrects and counts the waste ink amount when said mounted ink jet head is not replaced on said mounting portion.

6. An apparatus according to claim 3, wherein said waste ink is held in an ink absorbing member located in said platen.

7. An apparatus according to claim 3, wherein said waste ink is held in an ink absorbing member located in said platen and exhausted from an opening provided in said platen.

8. A method for monitoring an ink level in an waste ink container, said waste ink container determining a waste ink amount of a recording apparatus on which a plurality of kinds of ink jet heads each having different properties regarding an ink exhaust amount are separately mounted, said method comprising the steps of:

detecting ink exhaust properties of an ink jet head mounted on said mounting portion; and correcting the waste ink amount exhausted from the mounted ink jet head in accordance with the ink exhaust properties detected at said detecting step.

9. A method according to claim 8, wherein at said correcting step a value of the corrected waste ink amount is counted in accordance with an ambient temperature.

10. An ink jet recording apparatus for separately mounting a plurality of kinds of ink jet recording heads each having different properties with respect to the ink discharge amount on a mounting portion thereof, said apparatus comprising:

a waste ink container for containing a waste ink expelled from said ink jet recording head;

assuming means for assuming an amount of the waste ink in said waste ink container, said assuming means having detecting means for detecting ink exhaust properties of an ink jet recording head mounted on said mounting portion, and calculating means for calculating the waste ink amount exhausted from said mounted ink jet recording head in accordance with the detected properties of said mounted ink jet recording head.

11. An ink jet recording apparatus according to claim 10, further comprising storage means for storing an assumed amount of waste ink in said waste ink container, and means for replacing the assumed amount with a sum of the calculated amount of waste ink from said calculating means and the assumed amount currently stored in said storage means.

12. An ink jet recording apparatus according to claim 11, wherein said calculating means calculates said waste ink amount exhausted from said mounted ink jet recording head also based on a sum of an amount of ink exhausted by suction and an amount of ink exhausted by preliminary discharge.

13. An ink jet recording apparatus according to claim 12, wherein estimated amounts corresponding to ink exhausted by suction and by preliminary discharge are stored in storage means and accessed by said calculating means.

14. A method for assuming an amount of the waste ink in a waste ink container expelled from an ink jet recording head, a plurality of kinds of ink jet recording heads each having different properties with respect to the ink discharge amount being separately mounted on a mounting portion thereof, said method comprising the steps of:

detecting ink exhaust properties of an ink jet recording head mounted on said mounting portion; and calculating the waste ink amount exhausted from said mounted ink jet recording head in accordance with the detected properties of said mounted ink jet recording head.

15. A method apparatus according to claim 14, wherein an assumed amount of waste ink in said waste ink container is stored in storage means, and further comprising the step of replacing the assumed amount with a sum of the calculated amount of waste ink from said calculating step and the assumed amount currently stored in said storage means.

16. A method according to claim 14, wherein said calculating step calculates said waste ink amount exhausted from said mounted ink jet recording head also based on a sum of an amount of ink exhausted by suction and an amount of ink exhausted by preliminary discharge.

17. A method according to claim 16, wherein estimated amounts corresponding to ink exhausted by suction and by preliminary discharge are stored in storage means and accessed by said calculating step.

* * * * *

UNITED STATES PATENT AND TRADEMARK OFFICE

CERTIFICATE OF CORRECTION

PATENT NO. : 6,227,642 B1
DATED : May 8, 2001
INVENTOR(S) : Tadashi Hanabusa et al.

It is certified that error appears in the above-identified patent and that said Letters Patent is hereby corrected as shown below:

Title page,
Item [*], Notice, change the extension from "67 days" to -- 69 days --.

Column 3,
Line 46, "member. It" should read -- member. ¶ It --.

Column 6,
Line 51, "dourse" should read -- course --.

Column 13,
Line 10, "weighting a" should read -- weighting α --; and
Line 47, "-structure" should read -- structure --.

Column 16,
Line 9, "obtained. The" should read -- obtained. ¶ The --; and
Line 17, "objectives" should read -- objective --.

Column 24,
Line 42, "has" should read -- have --; and
Line 46, "to" (first occurrence) should be deleted.

Column 26,
Line 30, "an" should read -- a --.

Signed and Sealed this

Ninth Day of July, 2002

*Attest:*

*Attesting Officer*

JAMES E. ROGAN
*Director of the United States Patent and Trademark Office*